US011675296B2

(12) United States Patent
Tanaka et al.

(10) Patent No.: US 11,675,296 B2
(45) Date of Patent: Jun. 13, 2023

(54) IMAGE FORMING APPARATUS

(71) Applicant: Brother Kogyo Kabushiki Kaisha, Nagoya (JP)

(72) Inventors: Tokifumi Tanaka, Komaki (JP); Sadaharu Kato, Kariya (JP); Yusuke Mizuno, Nagoya (JP); Shuya Ichikawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/650,884

(22) Filed: Feb. 14, 2022

(65) Prior Publication Data

US 2022/0269197 A1 Aug. 25, 2022

(30) Foreign Application Priority Data

Feb. 19, 2021 (JP) ..... JP2021-025616

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 9,235,166 | B2 * | 1/2016 | Shimura | G03G 15/2042 |
| 2017/0010569 | A1 | 1/2017 | Seshita et al. | |
| 2018/0210380 | A1 | 7/2018 | Uchiyama et al. | |
| 2019/0235423 | A1 | 8/2019 | Kato | |

FOREIGN PATENT DOCUMENTS

| | | | |
|---|---|---|---|
| JP | 2006-010943 | A | 1/2006 |
| JP | 2006-221115 | A | 8/2006 |
| JP | 2012-220825 | A | 11/2012 |
| JP | 2017-021319 | A | 1/2017 |
| JP | 2018-120117 | A | 8/2018 |
| JP | 2019-132998 | A | 8/2019 |

* cited by examiner

*Primary Examiner* — Clayton E. LaBalle
*Assistant Examiner* — Michael A Harrison
(74) *Attorney, Agent, or Firm* — Burr Patent Law, PLLC

(57) ABSTRACT

An image forming apparatus includes a photoconductive drum, a developing roller, a sheet supplier, a fixing unit, and a controller. The fixing unit includes a heating roller, a first heater, a second heater, a first temperature sensor, and a second temperature sensor. The controller is configured to control the first heater so that a first detected-temperature becomes a target temperature at a central area, and control the second heater so that a second detected-temperature becomes a target temperature at an end area, and in accordance with a heat storage amount of the fixing unit stored by the heating of the second heater, change (i) a timing when supply of the sheet is started or (ii) the target temperature at the end area.

24 Claims, 11 Drawing Sheets

IMAGE FORMING APPARATUS

CROSS REFERENCE TO RELATED APPLICATION

The present application claims priority from Japanese Patent Application No. 2021-025616, which was filed on Feb. 19, 2021, the disclosure of which is herein incorporated by reference in its entirety.

BACKGROUND

The following disclosure relates to an image forming apparatus including a fixing unit that fixes a toner image on a sheet.

There has been known an image forming apparatus including a heating roller, a first heater configured to strongly heat a central area of the heating roller in a width direction of the sheet, a second heater configured to strongly heat end areas of the heating roller in the width direction of the sheet, a first temperature sensor configured to detect a temperature at the central area of the heating roller, a second temperature sensor configured to detect a temperature at the end area of the heating roller, and a controller. In this technique, the controller is configured to control the first heater so that a detected temperature by the first temperature sensor becomes a target temperature at the central area, and control the second heater so that a detected temperature by the second temperature sensor becomes a target temperature at the end area.

SUMMARY

Incidentally, it is preferable that the sheet is not heated more than necessary when being supplied to the fixing unit in the image forming apparatus. There is a possibility that a problem occurs when the sheet is heated more than necessary when being supplied to the fixing unit, for example, according to kinds of sheet usable in the image forming apparatus.

As an example, in a case where the sheet is paper having a resin coated layer on a surface, the coated layer may be deformed due to water vapor generated from the paper when the sheet is heated more than necessary when being supplied to the fixing unit. In order to solve such problem, the inventors of the present application have found that it is effective to execute control in accordance with a heat storage amount of the fixing unit stored by heating of the second heater.

The present disclosure has been made in view of the above background, and an object thereof is to provide an image forming apparatus capable of executing control in accordance with the heat storage amount of the fixing unit stored by the heating of the second heater.

In one aspect of the disclosure, an image forming apparatus configured to form an image on a sheet includes a photoconductive drum, a developing roller, a sheet supplier configured to supply a sheet to the photoconductive drum, a fixing unit configured to fix a toner image on a sheet, and a controller. The fixing unit includes a heating roller configured to heat the sheet, a first heater configured to heat a central area containing a central part of the heating roller in a width direction orthogonal to a conveying direction of the sheet, the first heater being configured to heat the central area more strongly than end areas respectively positioned on outer sides of the central area in the width direction of the heating roller, a second heater configured to heat the end areas more strongly than the central area, a first temperature sensor for detecting a temperature at the central area, and a second temperature sensor for detecting a temperature at the end area. The controller is configured to control the first heater so that a first detected-temperature detected by the first temperature sensor becomes a target temperature at the central area, and control the second heater so that a second detected-temperature detected by the second temperature sensor becomes a target temperature at the end area, and in accordance with a heat storage amount of the fixing unit stored by the heating of the second heater, change (i) a timing when supply of the sheet is started or (ii) the target temperature at the end area.

In another aspect of the disclosure, an image forming apparatus configured to form an image on a sheet includes a photoconductive drum, a developing roller, a sheet supplier configured to supply a sheet to the photoconductive drum, a fixing unit configured to fix a toner image on a sheet, the fixing unit including a heating roller, a heater configured to heat the heating roller, a temperature sensor for detecting a temperature of the heating roller, and a controller. The controller is configured to control the heater so that a detected-temperature detected by the temperature sensor becomes a target temperature, accumulate a parameter which is proportion to an output of the heater by each unit time, and in accordance with accumulated value of the parameter, change (i) a timing of starting supply of the sheet or (ii) the target temperature of the heating roller.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Next, a first embodiment will be explained in detail suitably with reference to the drawings.

Figure 1:
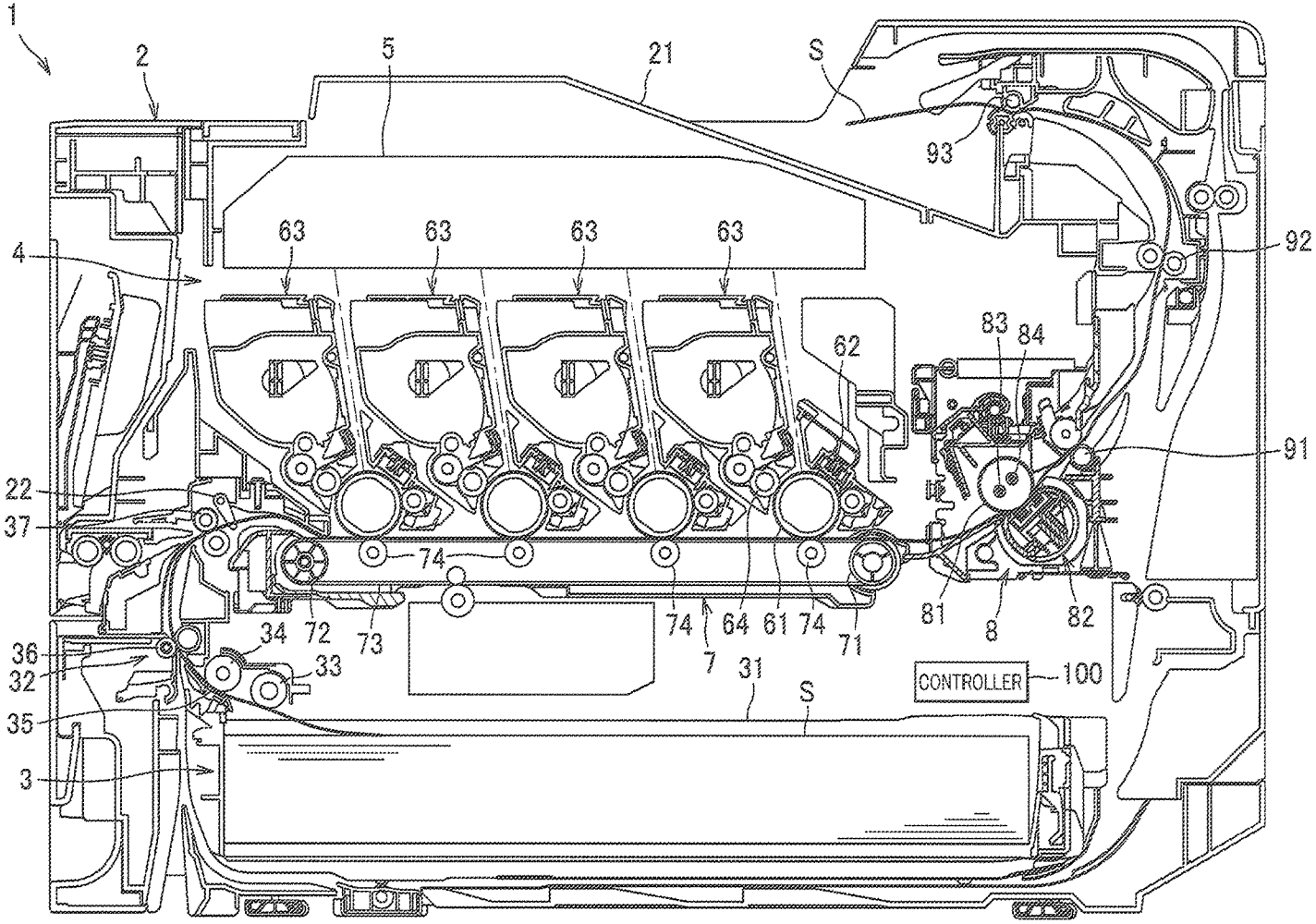
FIG. 1 is a view illustrating a configuration of an image forming apparatus.

As illustrated in FIG. 1, an image forming apparatus 1 is an apparatus configured to form an image on a sheet S while conveying the sheet S. The image forming apparatus 1 is a color printer capable of forming a color image, including a sheet supplier 3, an image forming unit 4, a sensor after registration 22, and a controller 100 inside a housing 2. The housing 2 has a discharge tray 21 on an upper surface of the housing 2.

The sheet supplier 3 has a function of supplying the sheet S to the image forming unit 4. The sheet supplier 3 includes a supply tray 31 capable of accommodating a plurality of sheet S and a sheet supply mechanism 32. The sheet supply mechanism 32 includes a pickup roller 33, a separation roller 34, a separation pad 35, a conveying roller 36, and a registration roller 37.

The sheet supplier 3 conveys the sheet S accommodated in the supply tray 31 by the pickup roller 33, separates the sheet S one by one by the separation roller 34 and the separation pad 35, and conveys the sheet S toward the registration roller 37 by the conveying roller 36. After that, the sheet supplier 3 aligns a position of a distal end of the sheet S by the registration roller 37 to thereby correct a skew of the sheet S and supply the sheet S to the image forming unit 4.

The image forming unit 4 has a function of forming the image on the sheet S. The image forming unit 4 includes an exposing unit 5, photoconductive drums 61, charging units 62, developing cartridges 63, a transfer unit 7, and a fixing unit 8. The image forming unit 4 includes four photoconductive drums 61, four charging units 62, and four developing cartridges 63.

The exposing unit 5 includes a plurality of light sources, polygon mirrors, lenses, reflection mirrors, and the like which are not illustrated. The exposing unit 5 exposes surfaces of the photoconductive drums 61 by emitting light beams (refer to long and short dashed lines) generated based on image data to thereby form electrostatic latent images on the surfaces of the photoconductive drums 61.

The photoconductive drum 61 is a member in which a photoconductor layer is formed on an outer circumference of a cylindrical drum body having conductivity. The four photoconductive drums 61 are arranged side by side in a conveying direction of the sheet S.

The charging unit 62 has a function of charging the surface of each of the photoconductive drums 61. The charging unit 62 includes a charging wire, a grid electrode and the like.

The developing cartridges 63 respectively have developing rollers 64 capable of holding toner. The developing cartridges 63 contain toner of yellow, magenta, cyan, and black thereinside.

The transfer unit 7 includes a drive roller 71, a driven roller 72, a conveying belt 73, and four transfer rollers 74. The conveying belt 73 is an endless belt, which is wound between the drive roller 71 and the driven roller 72. Each of the transfer rollers 74 is disposed inside the conveying belt 73 so that the conveying belt 73 is interposed between each of the transfer rollers 74 and a corresponding one of the photoconductive drums 61.

The fixing unit 8 has a function of fixing a toner image on the sheet S. The fixing unit 8 includes a heating roller 81, a pressure unit 82, a first heater 83, and a second heater 84. The heating roller 81 is a roller configured to heat the sheet S. The pressure unit 82 is disposed so that the sheet S is interposed between the pressure unit 82 and the heating roller 81, and has a function of applying a pressure to the sheet S with the heating roller 81. The heaters 83, 84 are disposed inside the heating roller 81. The heaters 83, 84 are, for example, halogen heaters configured to generate heat when being energized and configured to heat the heating roller 81. The details of the fixing unit 8 will be described below.

The image forming unit 4 causes the surfaces of the photoconductive drums 61 to be charged by the charging units 62 and to be exposed by the exposing unit 5. Accordingly, electrostatic latent images generated based on image data are formed on the surfaces of the photoconductive drums 61. Next, the image forming unit 4 supplies toner to the electrostatic latent images formed on the photoconductive drums 61 from the developing rollers 64. Accordingly, toner images are formed on the photoconductive drums 61.

Next, the image forming unit 4 causes the sheet S supplied from the sheet supplier 3 to pass between the photoconductive drums 61 and the transfer rollers 74 while conveying the sheet S by the conveying belt 73 to thereby transfer the toner images formed on the photoconductive drums 61 to the sheet S. Accordingly, the toner image is formed on the sheet S.

After that, the image forming unit 4 fixes the toner image on the sheet S by conveying the sheet S on which the toner image is formed between the heating roller 81 and the pressure unit 82. Accordingly, an image is formed on the sheet S. The sheet S on which the image is formed is conveyed by conveying rollers 91, 92 and discharged to the discharge tray 21 by an output roller 93.

The sensor after registration 22 has a function of detecting the sheet S supplied from the sheet supplier 3 toward the image forming unit 4. The sensor after registration 22 is disposed downstream of the registration roller 37 in the conveying direction of the sheet S. Specifically, the sensor after registration 22 is disposed between the registration roller 37 and the photoconductive drum 61 that is a photoconductive drum 61 of the four photoconductive drams 61 disposed on the most upstream position in the conveying direction of the sheet S.

As the sensor after registration 22, for example, a sensor including a lever configured to pivot when the sheet S comes into contact with the lever and an optical sensor configured to detect a position of the lever can be used. The sensor after registration 22 outputs a detection signal to the controller 100 when detecting the sheet S, and the sensor after registration 22 outputs a non-detection signal to the controller 100 when not detecting the sheet S. It does not matter which voltage is higher in the detection signal and the non-detection signal.

Next, the details of the fixing unit 8 will be explained.

Figure 2:
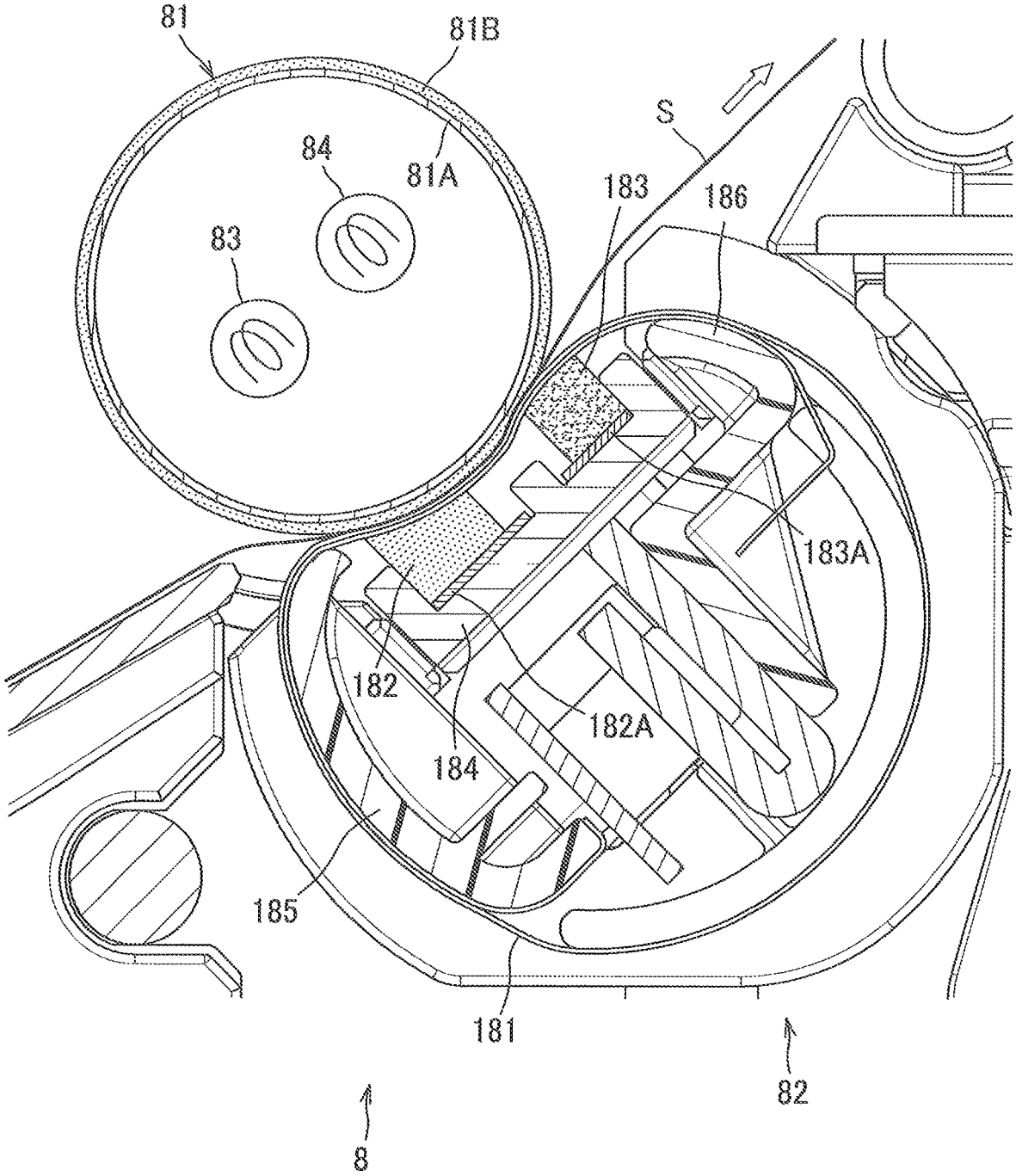
FIG. 2 is a cross-sectional view illustrating an entire configuration of a fixing unit.

As illustrated in FIG. 2, the heating roller 81 includes a tube blank 81A made of metal and an elastic layer 81B formed on an outer circumference of the tube blank 81A. In other words, the heating roller 81 has the elastic layer 81B on the outer circumference thereof. The elastic layer 81B is made of rubber such as silicone rubber, having elasticity. The heating roller 81 is rotatably supported by a not-illustrated frame of the fixing unit 8, and the heating roller 81 rotates when a rotation drive force is inputted.

The pressure unit 82 includes an endless belt 181, a first elastic member 182, a second elastic member 183, a support member 184, and belt guides 185, 186.

The endless belt 181 is a belt configured to convey the sheet S in a state in which the sheet S is interposed between the heating roller 81 and the endless belt 181. The endless belt 181 is made of metal.

Each of the first elastic member 182 and the second elastic member 183 is a member configured such that the endless belt 181 is interposed between the heating roller 81 and each of the first elastic member 182 and the second elastic member 183. Each of the first elastic member 182 and the second elastic member 183 is, for example, made of rubber such as silicone rubber and has elasticity in the same manner as the elastic layer 81B of the heating roller 81. The first elastic member 182 and the second elastic member 183 are disposed side by side in the conveying direction of the sheet S. Specifically, the second elastic member 183 is disposed downstream of the first elastic member 182 in the conveying direction of the sheet S.

The first elastic member 182 is softer than the elastic layer 81B and the second elastic member 183 is harder than the elastic layer 81B. In other words, the elastic layer 81B of the heating roller 81 is harder than the first elastic member 182 and softer than the second elastic member 183. According to the configuration, the second elastic member 183 can bite into the elastic layer 81B of the heating roller 81 through the endless belt 181; therefore, a direction of the sheet S can be changed between the heating roller 81 and the second elastic member 183 to peel off the sheet S from the heating roller 81.

The support member 184 is a member supporting the elastic members 182, 183. The first elastic member 182 is fixed to a first support plate 182A and supported by the support member 184 through the first support plate 182A. The second elastic member 183 is fixed to a second support plate 183A and supported by the support member 184 through the second support plate 183A.

The belt guides 185, 186 are members rotatably guiding the endless belt 181. The endless belt 181 is driven to rotate with respect to the heating roller 81 when the heating roller 81 rotates.

Figure 3A:
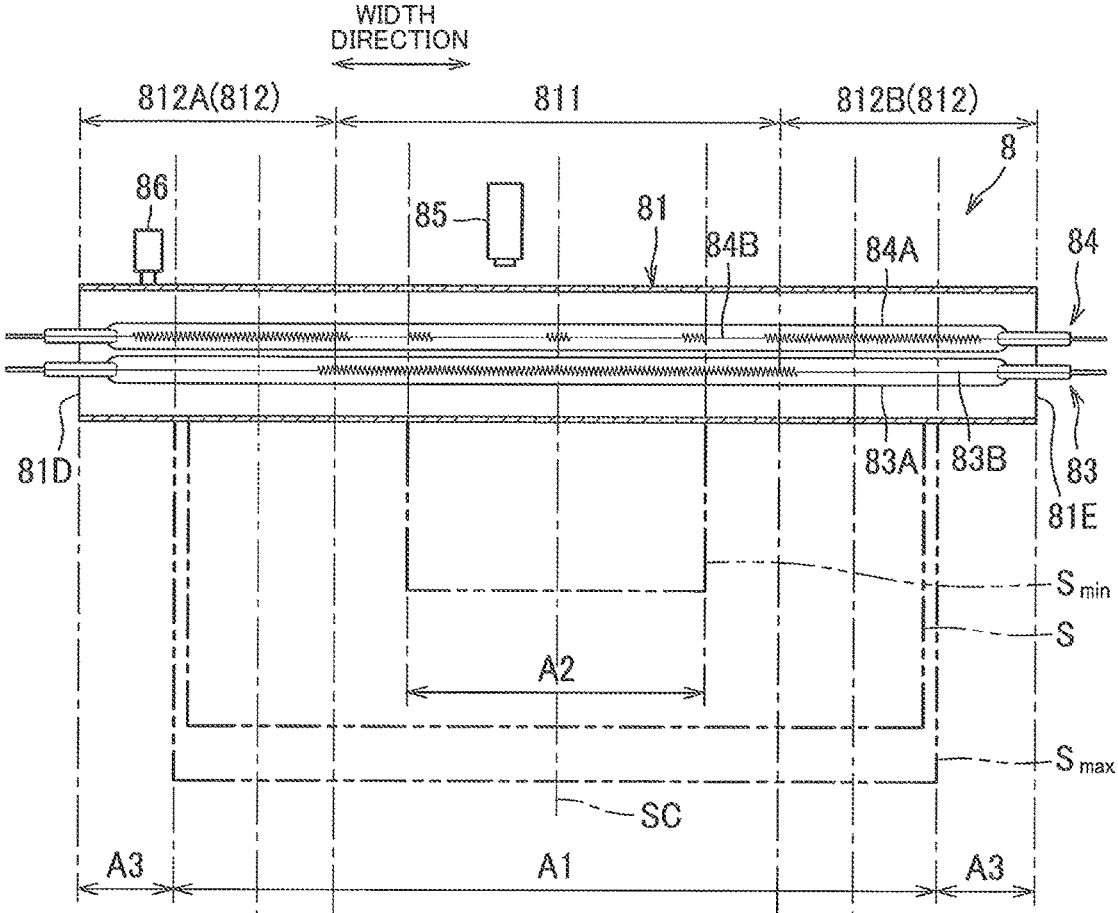
FIG. 3A is a view illustrating a configuration around a heating roller of the fixing unit.

As illustrated in FIG. 3A, the fixing unit 8 includes a first temperature sensor 85 and a second temperature sensor 86 in addition to the heating roller 81, the first heater 83, and the second heater 84.

The first heater 83 is a halogen heater having a glass tube 83A and a filament 83B provided inside the glass tube 83A. In the filament 83B, heat generating portions are gathered at a central part in a width direction of the sheet S as compared with respective end parts in the width direction of the sheet S. Accordingly, the first heater 83 heats a central area 811 of the heating roller 81 more strongly than end areas 812 of the heating roller 81. As illustrated by a broken line in FIG. 3B, the output of the first heater 83 has a distribution in which the output of the first heater 83 becomes the strongest at the central part in the width direction, and the output of the first heater 83 is gradually reduced toward both ends in the width direction.

Here, the width direction of the sheet S is a direction orthogonal to the conveying direction of the sheet S in the image forming unit 4. The width direction of the sheet S is referred to merely as a "width direction" in the following description. The central area 811 of the heating roller 81 is an area including a central part of the heating roller 81 in the width direction. The end areas 812 of the heating roller 81 are areas positioned on outer sides of the central area 811 of the heating roller 81 in the width direction. The heating roller 81 includes a first end area 812A as an area between one end edge 81D and the central area 811 of the heating roller 81 and a second end area 812B as an area between the other end edge 81E and the central area 811 of the heating roller 81 as the end areas 812.

Figure 3B:
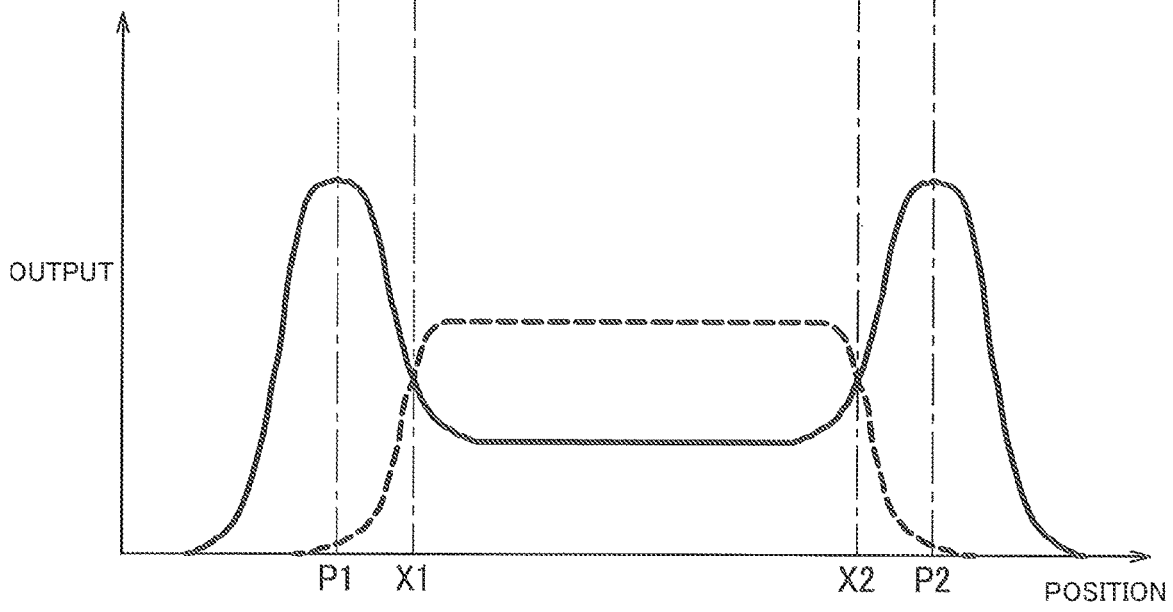
FIG. 3B is a graph illustrating outputs of respective heaters.

In the embodiment, borders between the central area 811 and the end areas 812 (812A, 812B) correspond to positions X1, X2 at which a magnitude relation between the maximum outputs of the second heater 84 illustrated by solid lines and the maximum output of the first heater 83 illustrated by a broken line in FIG. 3B is inverted. Here, the maximum output of the heater is an output obtained when power is supplied to each of the first heater 83 and the second heater 84 with the maximum energization duty ratio (100%).

The second heater 84 is a halogen heater having a glass tube 84A and a filament 84B provided inside the glass tube 84A. In the filament 84B, heat generating portions are gathered at respective end parts in the width direction as compared with the central part in the width direction. Accordingly, the second heater 84 heats the end areas 812 of the heating roller 81 more strongly than the central area 811. As illustrated by a solid line in FIG. 3B, the output of the second heater 84 has a distribution in which the output is stronger at the end parts in the width direction than at the central part.

The fixing unit 8 is set so that a range in which the output of the first heater 83 becomes maximum (peak position) and ranges in which the output of the second heater 84 becomes maximum (peak positions P1, P2) do not overlap in the width direction.

The peak position of the output of the first heater 83 in the width direction is located within a maximum contact area A1. Specifically, the peak position of the output of the first heater 83 in the width direction is located within a minimum contact area A2 in the width direction. The peak positions P1, P2 of the output of the second heater 84 in the width direction are located within the maximum contact area A1 in the width direction.

Here, the heating roller 81 includes the maximum contact area A1, the minimum contact area A2, and non-contact areas A3. The maximum contact area A1 is an area in which the heating roller 81 comes into contact with a sheet $S_{max}$ with the maximum size capable of being conveyed in the image forming unit 4 when the sheet $S_{max}$ with the maximum size in the width direction is conveyed. The maximum contact area A1 corresponds to the central area 811 and portions of the end areas 812 except outer end portions in the width direction.

The minimum contact area A2 is an area in which the heating roller 81 comes into contact with a sheet $S_{min}$ with the minimum size capable of being conveyed in the image forming apparatus 4 when the sheet $S_{min}$ with the minimum size in the width direction is conveyed. The minimum contact area A2 includes the central part of the central area 811 in the width direction. The non-contact areas A3 are areas in which the heating roller 81 does not come into contact with the sheet $S_{max}$ with the maximum size capable of being conveyed in the image forming unit 4 when the sheet $S_{max}$ with the maximum size in the width direction is conveyed. The non-contact areas A3 are outer end portions of the end areas 812 in the width direction.

The peak positions P1, P2 of the output of the second heater 84 in the width direction are located on outer sides of the minimum contact area A2 in the width direction. Each of the peak positions P1, P2 of the output of the second heater 84 is located on an inner side of the non-contact areas A3 in the width direction. That is, the peak positions P1, P2 of the output of the second heater 84 are located between the minimum contact area A2 and the non-contact areas A3 in the width direction.

In the respective heaters 83, 84, specifications of light distribution are specified, and the specifications are defined by a predetermined detection method. As a detection method for the output (light distribution) of the respective heaters 83, 84, for example, a method in which an optical sensor for detecting light of the heater is disposed spaced apart from the heater by a predetermined distance and a light amount of the heater is detected can be adopted. The predetermined distance is a distance from the heater to an inner circumferential surface of the heating roller 81.

The first temperature sensor 85 is a sensor for detecting the temperature at the central area 811. Specifically, the first temperature sensor 85 detects the temperature at the minimum contact area A2 in the central area 811. A first detected-temperature TD1 detected by the first temperature sensor 85 is outputted to the controller 100.

The first temperature sensor 85 is located at a position displaced to the first end area 812A side with respect to the center (a conveying center SC) of the heating roller 81 in the width direction. The first temperature sensor 85 detects the first detected-temperature TD1 in a state in which the first temperature sensor 85 is not in contact with the heating roller 81. That is, a first temperature sensor is configured to detect a first detected-temperature in a state in which the first temperature sensor is not in contact with a heating roller. Specifically, the first temperature sensor 85 is disposed spaced apart from an outer circumferential surface of the heating roller 81. As the first temperature sensor 85, for example, a non-contact thermistor can be used. In the embodiment, the image forming apparatus 1 conveys the sheet S by setting the center of the heating roller 81 in the width direction as the conveying center SC at the time of conveying the sheet S in the fixing unit 8.

The second temperature sensor 86 is a sensor for detecting the temperature of the end area 812. Specifically, the second temperature sensor 86 detects the temperature of the first end area 812A in the end areas 812. More specifically, the second temperature sensor 86 detects the temperature of the non-contact area A3 in the first end area 812A. A second detected-temperature TD2 detected by the second temperature sensor 86 is outputted to the controller 100.

In the width direction, the second temperature sensor 86 is located at a position different from the peak positions P1, P2 of the output of the second heater 84 in the width direction. Specifically, the second temperature sensor 86 is located on an outer side of the peak position P1 of the output of the second heater 84 in the width direction. More specifically, the second temperature sensor 86 is located on an outer side of the maximum contact area A1 in the width direction. The second temperature sensor 86 detects the second detected-temperature TD2 in a state in which the second temperature sensor 86 is in contact with the heating roller 81. A second temperature sensor is configured to detect a second detected-temperature in a state in which the second temperature sensor is in contact with a heating roller. As the second temperature sensor 86, for example, a contact thermistor can be used.

The controller 100 (see FIG. 1) includes a CPU, a RAM, a ROM, an input/output circuit, and the like, and is configured to execute a control by executing various calculation processes based on programs or data stored in the ROM and the like.

Figure 4:
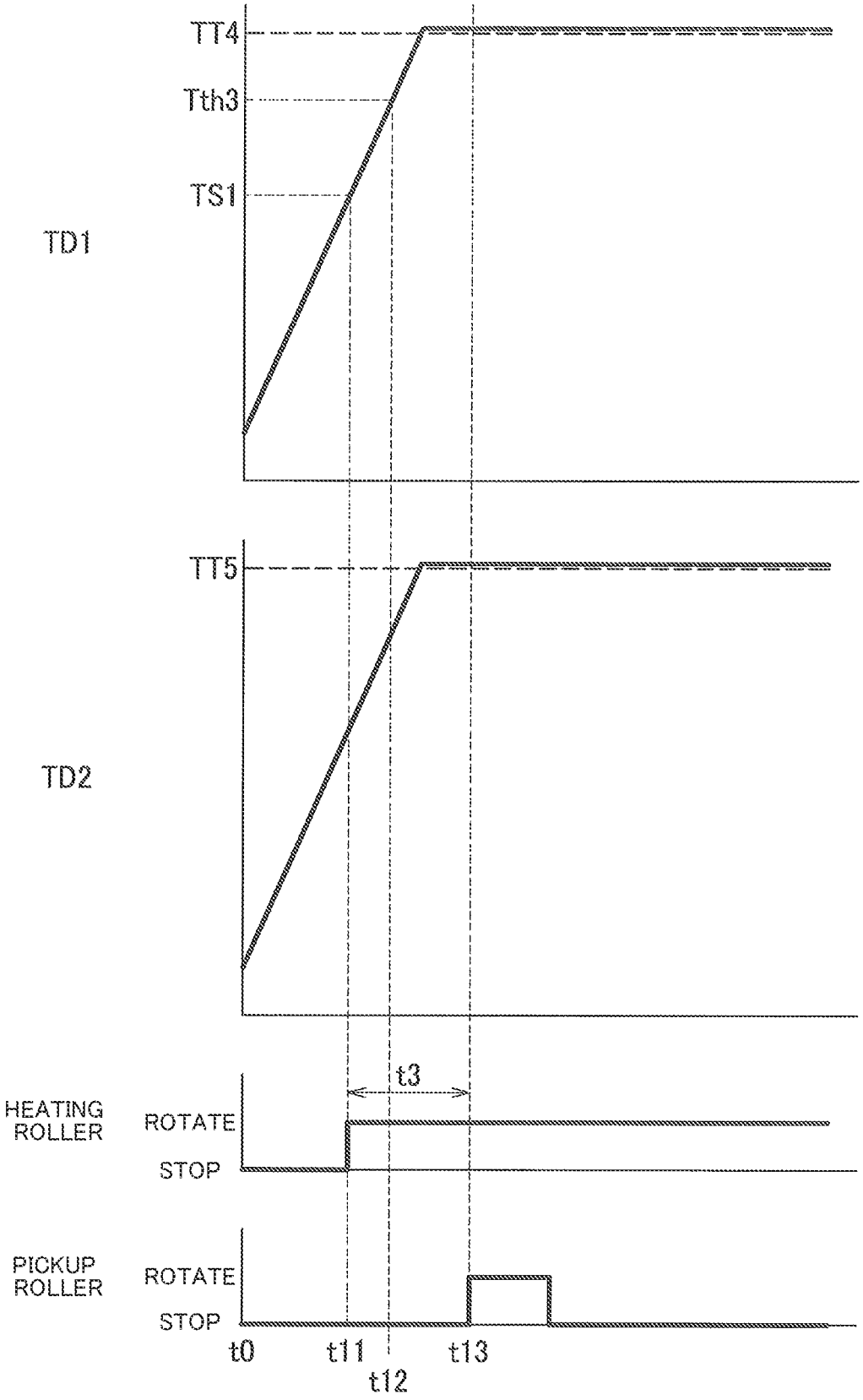
FIG. 4 is a timing chart for explaining control executed when starting image forming on a sheet of a second kind of sheet according to the first embodiment.

As illustrated in FIG. 4, in a case where a target temperature at the central area 811 of the heating roller 81 is set to a predetermined target temperature, the controller 100 controls the output of the first heater 83 by controlling energization of the first heater 83 so that the first detected-temperature TD1 detected by the first temperature sensor 85 becomes the set target temperature (for example, TT4) at the central area 811. Specifically, the controller 100 executes a feedback process in which the energization duty ratio of AC voltage to energize the first heater 83 is determined based on a difference between the first detected-temperature TD1 and the target temperature, and an energization amount per a unit time to the first heater 83 is controlled based on the determined energization duty ratio.

In a case where the target temperature at the end area 812 of the heating roller 81 is set to a predetermined target temperature, the controller 100 also controls the output of the second heater 84 by controlling energization to the second heater 84 so that the second detected-temperature TD2 detected by the second temperature sensor 86 becomes the set target temperature (for example, TT5) at the end area 812. Specifically, the controller 100 executes a feedback process in which the energization duty ratio of AC voltage to energize the second heater 84 is determined based on a difference between the second detected-temperature TD2 and the target temperature, and an energization amount per a unit time to the second heater 84 is controlled based on the determined energization duty ratio.

The energization duty ratio is determined so as to become closer to 100% as a value obtained by subtracting the detected-temperature from the target temperature is large. When the detected-temperature is larger than the target temperature, the energization duty ratio is determined to be 0%.

Figure 5:
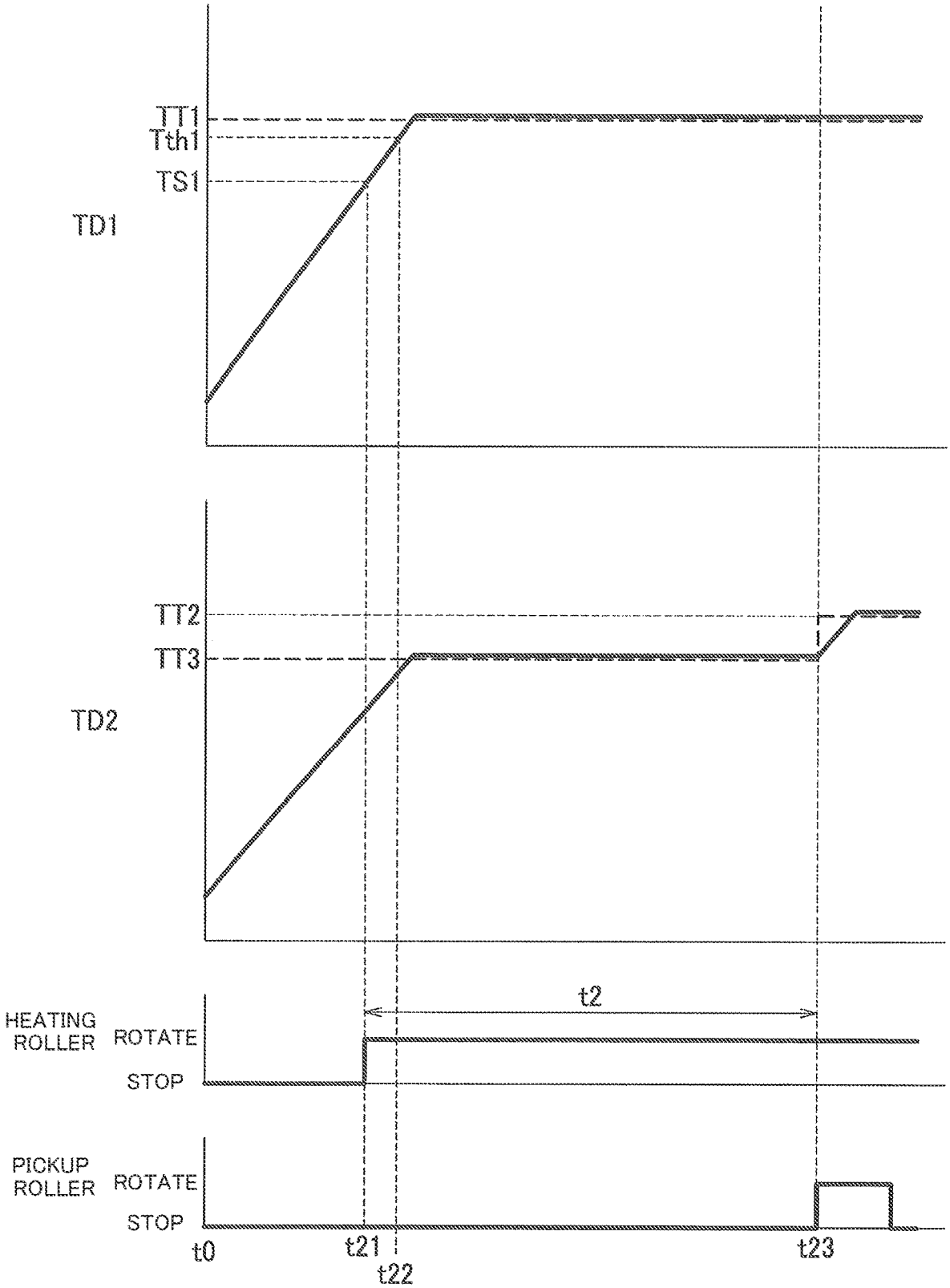
FIG. 5 is a timing chart for explaining control executed in a case where a heat storage amount of the fixing unit is less than a predetermined amount when starting image forming on a first kind of sheet according to the first embodiment.
Figure 6:
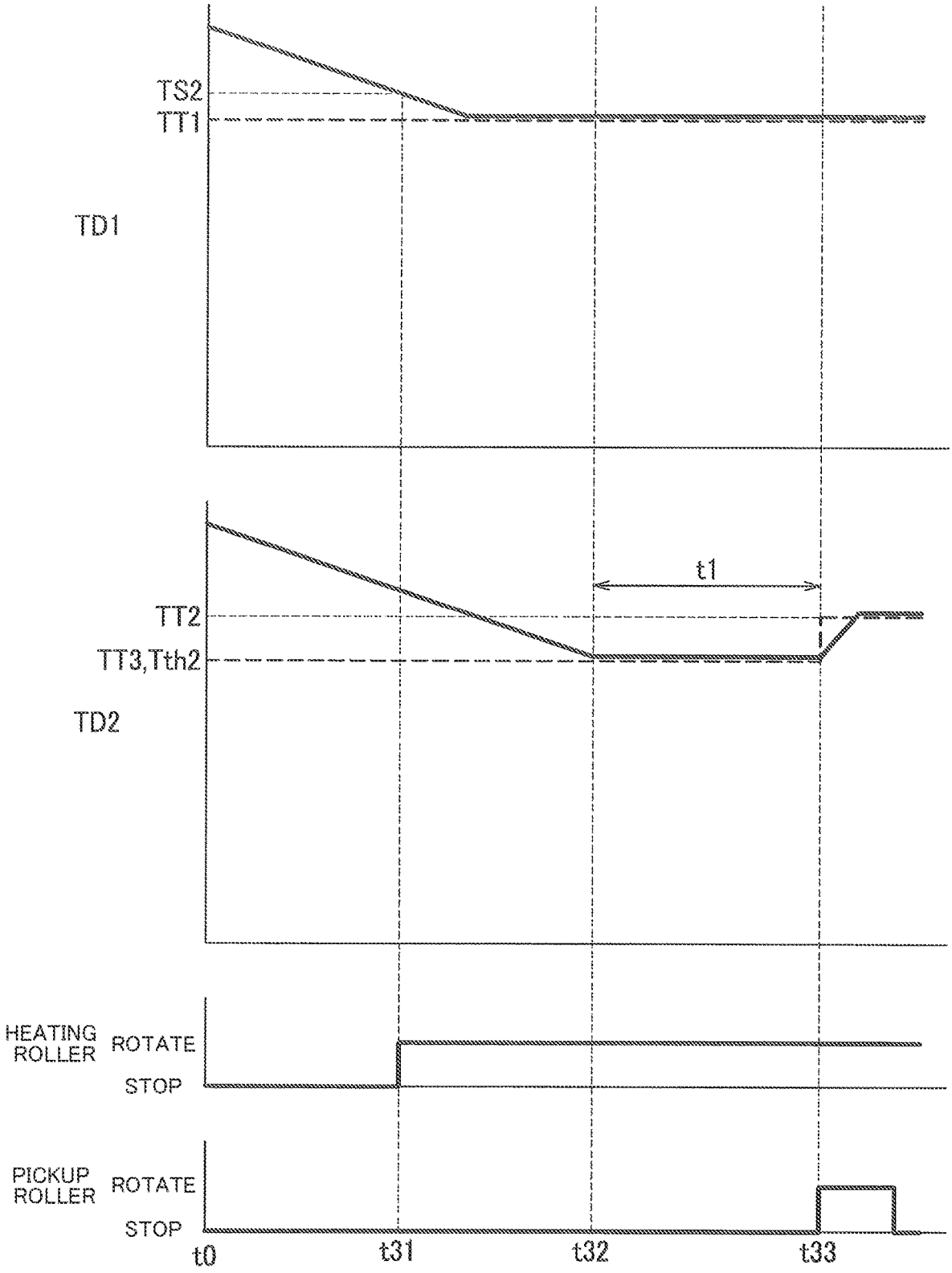
FIG. 6 is a timing chart for explaining control executed in a case where the heat storage amount of the fixing unit is equal to or greater than the predetermined amount when starting the image forming on the first kind of sheet according to the embodiment.

As illustrated in FIG. 5 and FIG. 6, the controller 100 sets the target temperature at the central area 811 of the heating roller 81 to a first target temperature TT1 and sets the target temperature at each of the end areas 812 to a second target temperature TT2 when the toner image is fixed on a first kind of sheet S. As illustrated in FIG. 4, the controller 100 sets the target temperature at the central area 811 of the heating roller 81 to a fourth target temperature TT4 and sets the target temperature at the end area 812 to a fifth target temperature TT5 when the toner image is fixed on a second kind of sheet S which is different from the first kind of sheet S.

In the embodiment, the first kind of sheet S is paper having a coated layer of resin or the like on the surface thereof, and the first kind of sheet S is, for example, coated paper such as glossy paper. That is, a first kind of sheet is paper having a coated layer on a surface. The second kind of sheet S is paper not having the coated layer on the surface thereof, and the second kind of sheet S is, for example, plain paper. The determination whether the sheet S is the first kind of sheet S or the second kind of sheet S by the controller 100 can be made based on information indicating the kind of sheet S, which is, for example, received with a command for starting printing. In the following description, the first kind of sheet S may be referred to as a "sheet S1" and the second kind of sheet S may be referred to as a "sheet S2".

In the embodiment, the first target temperature TT1 to be set when the toner image is fixed on the sheet S1 is less than the fourth target temperature TT4 to be set when the toner image is fixed on the sheet S2, and the second target temperature TT2 to be set when the toner image is fixed on the sheet S1 is less than the fifth target temperature TT5 to be set when the toner image is fixed on the sheet S2. The first target temperature TT1 and the second target temperature TT2 may be the same temperature as well as may be different temperatures. The fourth target temperature TT4 and the fifth target temperature TT5 may be the same temperature as well as may be different temperatures.

As illustrated in FIG. 5 and FIG. 6, in a case where the controller 100 starts image forming on the sheet S1 such as coated paper, the controller 100 sets the target temperature of each of the end areas 812 of the heating roller 81 to a third target temperature TT3 before supply of the sheet S1 to the image forming unit 4 from the supply tray 31 is started. As an example, when the supply of the sheet S1 is started (times "t23", "t33"), the controller 100 changes the target temperature of each of the end areas 812 from the third target temperature TT3 to the second target temperature TT2 which is to be set when the toner image is fixed. The third target temperature TT3 is a temperature less than the second target temperature TT2.

As illustrated in FIG. 4, in a case where image formation on the sheet S2 such as plain paper is started, the controller 100 starts the supply of the sheet S2 on condition that the first detected-temperature TD1 becomes equal to or greater than a third threshold temperature Tth3. Specifically, in the case where image formation on the sheet S2 is started, when a condition that the first detected-temperature TD1 becomes equal to or greater than the third threshold temperature Tth3 in a period from a timing when the heating roller 81 is stared to be rotated to a timing when the third period of time t3 has passed from the start of rotation of the heating roller 81 is satisfied, the controller 100 is configured to start supply of the sheet S2 by rotating the pickup roller 33 at a timing when the third period of time t3 has passed from the timing of start of rotation of the heating roller 81.

The third threshold temperature Tth3 is a temperature less than the fourth target temperature TT4 which is the target temperature at the central area 811 of the heating roller 81 to be set when the toner image is fixed on the sheet S2.

The controller 100 starts rotation of the heating roller 81 when the first detected-temperature TD1 becomes equal to or greater than a first rotation start temperature TS1. The first rotation start temperature TS1 is a temperature less than the fourth target temperature TT4 as well as less than the third threshold temperature Tth3.

As illustrated in FIG. 5 and FIG. 6, in the case where the controller 100 starts the image forming on the sheet S1 such as coated paper, the controller 100 changes the timing of starting the supply of the sheet S1 in accordance with a heat storage amount of the fixing unit 8 stored by heating of the second heater 84.

Specifically, as illustrated in FIG. 5, in the case where the controller 100 starts the image forming on the sheet S1 such as coated paper, the controller 100 starts the supply of the sheet S1 on condition that the first detected-temperature TD1 becomes equal to or greater than a first threshold temperature Tth1 when the heat storage amount of the fixing unit 8 is less than a predetermined amount. Specifically, in a case where a condition that the first detected-temperature TD1 becomes equal to or greater than the first threshold temperature Tth1 in a period from a timing when the heating roller 81 is started to be rotated to a timing when a second period of time t2 has passed from the start of rotation of the heating roller 81 when the heat storage amount of the fixing unit 8 is less than the predetermined amount is satisfied, the controller 100 is configured to start the supply of the sheet by rotating the pickup roller 33 when the second period of time t2 has passed from the timing of start of rotation of the heating roller 81

Here, the case where the heat storage amount of the fixing unit 8 is less than the predetermined amount when the controller 100 starts the image forming on the sheet S is a case, for example, where the controller 100 starts the image forming by an input of a print job including the command for starting printing, information for the kind of sheet S, image data, and the like in a state in which the heating roller 81 is cooled to near room temperature.

The first threshold temperature Tth1 is a temperature less than the first target temperature TT1 that is the target temperature at the central area 811 of the heating roller 81 to be set when the toner image is fixed on the sheet S1. The second period of time t2 is a longer period of time than the third period of time t3.

The controller 100 starts the rotation of the heating roller 81 when the first detected-temperature TD1 becomes equal to or greater than the first rotation start temperature TS1. The first rotation start temperature TS1 is a temperature less than the first threshold temperature Tth1.

As illustrated in FIG. 6, in a case where the controller 100 starts the image forming on the sheet S1 such as coated paper and the heat storage amount of the fixing unit 8 is equal to or greater than the predetermined amount, the controller 100 starts the supply of the sheet S1 on condition that the second detected-temperature TD2 becomes equal to or less than a second threshold temperature Tth2. Specifically, in a case where a condition that the second detected-temperature TD2 becomes, after starting the rotation of the heating roller 81, equal to or less than the second threshold temperature Tth2 when the heat storage amount of the fixing unit 8 is equal to or greater than the predetermined amount is satisfied, the controller 100 is configured to start the supply of the sheet S1 by rotating the pickup roller 33 at a timing when the first period of time t1 has passed from a timing when the second detected-temperature TD2 becomes the second threshold temperature Tth2.

Here, the case where the heat storage amount of the fixing unit 8 is equal to or greater than the predetermined amount when the controller 100 starts the image forming on the sheet S is a case, for example, where the controller 100 starts the image forming by an input of the print job inputted just after printing continuously on a plurality of sheets S. In this case, the heating roller 81 has a temperature close to the target temperature which is a temperature just before the continuous printing on the plurality of sheets S is ended. In some cases, the heating roller 81 has a temperature equal to or greater than the target temperature because heat is not deprived by the sheet S after the continuous printing is ended.

The second threshold temperature Tth2 is a temperature less than the second target temperature TT2 that is the target temperature at the end area 812 of the heating roller 81 to be set when the toner image is fixed on the sheet S1. In the embodiment, the second threshold temperature Tth2 is the temperature less than the second target temperature TT2, and the same temperature as the third target temperature TT3 that is the target temperature at the end area 812 before starting the supply of the sheet S1. The second threshold temperature Tth2 may be a temperature greater than the third target temperature TT3. The first period of time t1 is a period of time shorter than the second period of time t2.

The controller 100 starts the rotation of the heating roller 81 when the first detected-temperature TD1 becomes equal to or less than a second rotation start temperature TS2. The second rotation start temperature TS2 is a temperature greater than the second target temperature TT2.

In the embodiment, the controller 100 determines whether the heat storage amount of the fixing unit 8 stored by the heating of the second heater 84 is equal to or greater than the predetermined amount or not in the following manner. That is, the controller 100 first accumulates a parameter Pa which is proportion to the output of the second heater 84 by each unit time tc. Then, the controller 100 determines that the heat storage amount of the fixing unit 8 is less than the predetermined amount when an accumulated value J of the parameter Pa is less than a predetermined threshold value Jc1. The controller 100 determines that the heat storage amount of the fixing unit 8 is equal to or greater than the predetermined amount when the accumulated value J of the parameter Pa is equal to or greater than the threshold value Jc1.

The parameter Pa which is proportion to the output of the second heater 84 can be calculated, for example, by the following formula.

$$Pa=D2\times tc\times a$$

Here, D2 is the energization duty ratio of the second heater 84, and "a" is a given coefficient.

The coefficient "a" is used when a method for calculating the parameter Pa is changed between a case of a print mode in which the image is formed on the sheet S and a case of a ready mode in which the input of the print job is waited for. As an example, the coefficient "a" is set to "1" in the case of the print mode, and the coefficient "a" is set to a value greater than "0" and less than "1" in the case of the ready mode. When the above change of the method by each of the case of the print mode and the case of the ready mode is not executed, for example, the coefficient "a" may be fixed to "1" ("a" is set as a constant) or a formula in which terms are not multiplied by the coefficient "a" (Pa=D2×tc) may be used.

The controller 100 calculates the accumulated value J of the parameter Pa by each unit time tc after the power of the image forming apparatus 1 is supplied. Specifically, the controller 100 starts accumulation of the parameter Pa when the second detected-temperature TD2 becomes equal to or greater than a predetermined temperature TP. Specifically, when the second detected-temperature TD2 is equal to or greater than the predetermined temperature TP, the parameter Pa is calculated by each unit time tc and the calculated parameter Pa is added to a previous value of the accumulated value J, thereby calculating a current value of the accumulated value J. The controller 100 also resets the accumulated value J of the parameter Pa when the second detected-temperature TD2 becomes less than the predetermined temperature TP. Specifically, the controller 100 sets the accumulated value J to "0" when the second detected-temperature TD2 becomes less than the predetermined temperature TP.

The predetermined temperature TP is a temperature less than the target each of temperatures TT1 to TT5. The predetermined temperature TP is a temperature less than each of the threshold temperatures Tth1 to Tth3. The predetermined temperature TP is a temperature, for example, less than the first rotation start temperature TS1.

Next, an example of operations of the controller 100 according to the first embodiment will be explained more specifically while referring to flowcharts and timing charts.

First, an accumulation calculation process will be explained with reference to FIG. 7.

Figure 7:
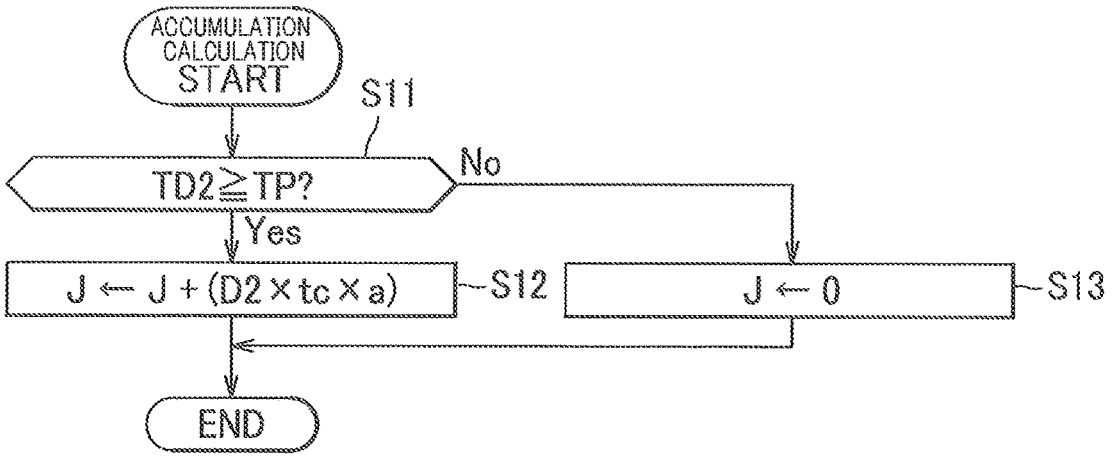
FIG. 7 is a flowchart illustrating an accumulation calculation process.

The controller 100 repeatedly executes the accumulation calculation process illustrated in FIG. 7 by each unit time tc (a predetermined control cycle) after the power of the image forming apparatus 1 is supplied.

The controller 100 determines whether the second detected-temperature TD2 becomes equal to or greater than the predetermined temperature TP or not (S11). When it is determined that the second detected-temperature TD2 is equal to or greater than the predetermined temperature TP (S11, Yes), the controller 100 calculates a current value of the accumulated value J of the parameter Pa (S12) and ends the current process. When the second detected-temperature TD2 is less than the predetermined temperature TP (S11, No), the controller 100 resets the accumulated value J of the parameter Pa to "0" (S13) and ends the current process.

Next, a sheet supplying process will be explained with reference to FIG. 8 and FIG. 4 to FIG. 6.

The controller 100, when receiving the print job (FIG. 4 to FIG. 6, t0), determines whether printing corresponding to the received print job is printing on the sheet S1 such as coated paper or not (S101). When the printing corresponding to the received print job is not the printing on the sheet S1 (S101, No), that is, the printing corresponding to the received print job is printing on the sheet S2 such as plain paper, the controller 100 sets the threshold temperature Tth to the third threshold temperature Tth3 and sets a predetermined time tp to the third period of time t3 (S111).

Next, the controller 100 determines whether the first detected-temperature TD1 becomes equal to or greater than the first rotation start temperature TS1 or not (S113). When it is determined that the first detected-temperature TD1 is less than the first rotation start temperature TS1 (S113, No), the controller 100 waits until the first detected-temperature TD1 becomes equal to or greater than the first rotation start temperature TS1. When it is determined that the first detected-temperature TD1 becomes equal to or greater than the first rotation start temperature TS1 (S113, Yes), the controller 100 starts rotation of the heating roller 81 (S114) (FIG. 4, t11).

Next, the controller 100 determines whether the first detected-temperature TD1 becomes equal to or greater than the threshold temperature Tth (the third threshold temperature Tth3) or not (S115). When it is determined that the first detected-temperature TD1 is less than the threshold temperature Tth (S115, No), the controller 100 wait until the first detected-temperature TD1 become equal to or greater than the threshold temperature Tth. When it is determined that the first detected-temperature TD1 becomes equal to or greater than the threshold temperature Tth (the third threshold temperature Tth3) (S115, Yes) (FIG. 4, t12), the controller 100 determines whether the predetermined time tp (the third period of time t3) has passed from the start of rotation of the heating roller 81 (S116).

When it is determined that the predetermined time tp has not passed (S116, No), the controller 100 waits until the time passes. When the predetermined time tp (the third period of time t3) has passed (S116, Yes), the controller 100 rotates the pickup roller 33 to start the supply of the sheet S2 such as plain paper (S131) (FIG. 4, t13).

On the other hand, when the printing corresponding to the received print job is the printing on the sheet S1 such as coated paper at Step S101 (Yes), the controller 100 determines whether the accumulated value J of the parameter Pa is equal to or greater than the predetermined threshold value Jc1 or not (S102). When it is determined that the accumulated value J of the parameter Pa is less than the threshold value Jc1 (S102, No), the heat storage amount of the fixing unit 8 is less than the predetermined amount; therefore, the controller 100 sets the threshold temperature Tth to the first threshold temperature Tth1 and sets the predetermined time tp to the second time t2 (S112).

Next, the controller 100 determines whether the first detected-temperature TD1 becomes equal to or greater than the first rotation start temperature TS1 or not (S113). When it is determined that the first detected-temperature TD1 becomes equal to or greater than the first rotation start temperature TS1 (Yes), the controller 100 starts the rotation of the heating roller 81 (S114) (FIG. 5, t21). Next, the controller 100 determines whether the first detected-temperature TD1 becomes equal to or greater than the threshold temperature Tth (the first threshold temperature Tth1) or not (S115). When it is determined that the first detected-temperature TD1 becomes equal to or greater than the threshold temperature Tth (the first threshold temperature Tth1) (Yes) (FIG. 5, t22), the controller 100 determines whether the predetermined time tp (the second period of time t2) has passed from the start of the rotation of the heating roller 81 (S116).

When it is determined that the predetermined time tp (the second period of time t2) has passed (S116, Yes), the controller 100 rotates the pickup roller 33 to start the supply of the sheet S1 such as coated paper (S131) (FIG. 5, t23).

When it is determined that the accumulated value J of the parameter Pa is equal to or greater than the threshold value Jc1 at Step S102 (S102, Yes), the heat storage amount of the fixing unit 8 is equal to or greater than the predetermined amount; therefore, the controller 100 determines whether the first detected-temperature TD1 becomes equal to or less than the second rotation start temperature TS2 or not (S123). When it is determined that the first detected-temperature TD1 exceeds the second rotation start temperature TS2 (S123, No), the controller 100 waits until the first detected-temperature TD1 becomes equal to or less than the second rotation start temperature TS2. When it is determined that the first detected-temperature TD1 becomes equal to or less than the second rotation start temperature TS2 (S123, Yes), the controller 100 starts rotation of the heating roller 81 (S124) (FIG. 6, t31).

Next, the controller 100 determines whether the second detected-temperature TD2 becomes equal to tor less than the second threshold temperature Tth2 or not (S125). When it is determined that the second detected-temperature TD2 exceeds the second threshold temperature Tth2 (S125, No), the controller 100 waits until the second detected-temperature TD2 becomes equal to tor less than the second threshold temperature Tth2. When it is determined that the second detected-temperature TD2 becomes equal to tor less than the second threshold temperature Tth2 (S125, Yes) (FIG. 6, t32), the controller 100 determines whether the first period of time t1 has passed from a timing when the second detected-temperature TD2 becomes equal to or less than the second threshold temperature Tth2 (S126).

When it is determined that the first period of time t1 has not passed (S126, No), the controller 100 waits until the time passes. When it is determined that the first period of time t1 has passed (S126, Yes), the controller 100 rotates the pickup roller 33 and starts the supply of the sheet S1 such as coated paper (S131) (FIG. 6, t33).

After that, the controller 100 determines whether a next page exists in the print job or not (S141). When it is determined that the next page exists (S141, Yes), the controller 100 determines whether a predetermined period of time t91 has passed from a timing when the sensor after registration 22 does not detect a preceding sheet S or not (S142). When it is determined that the predetermined period of time t91 has not passed (S142, No), the controller 100 waits until the time passes. When it is determined that the predetermined period of time t91 has passed (S142, Yes), the controller 100 returns to the process of Step S131, and rotates the pickup roller 33 and starts supply of a next sheet S (the second and subsequent sheets S). After that, the controller 100 executes the process of Step S141.

Figure 8:
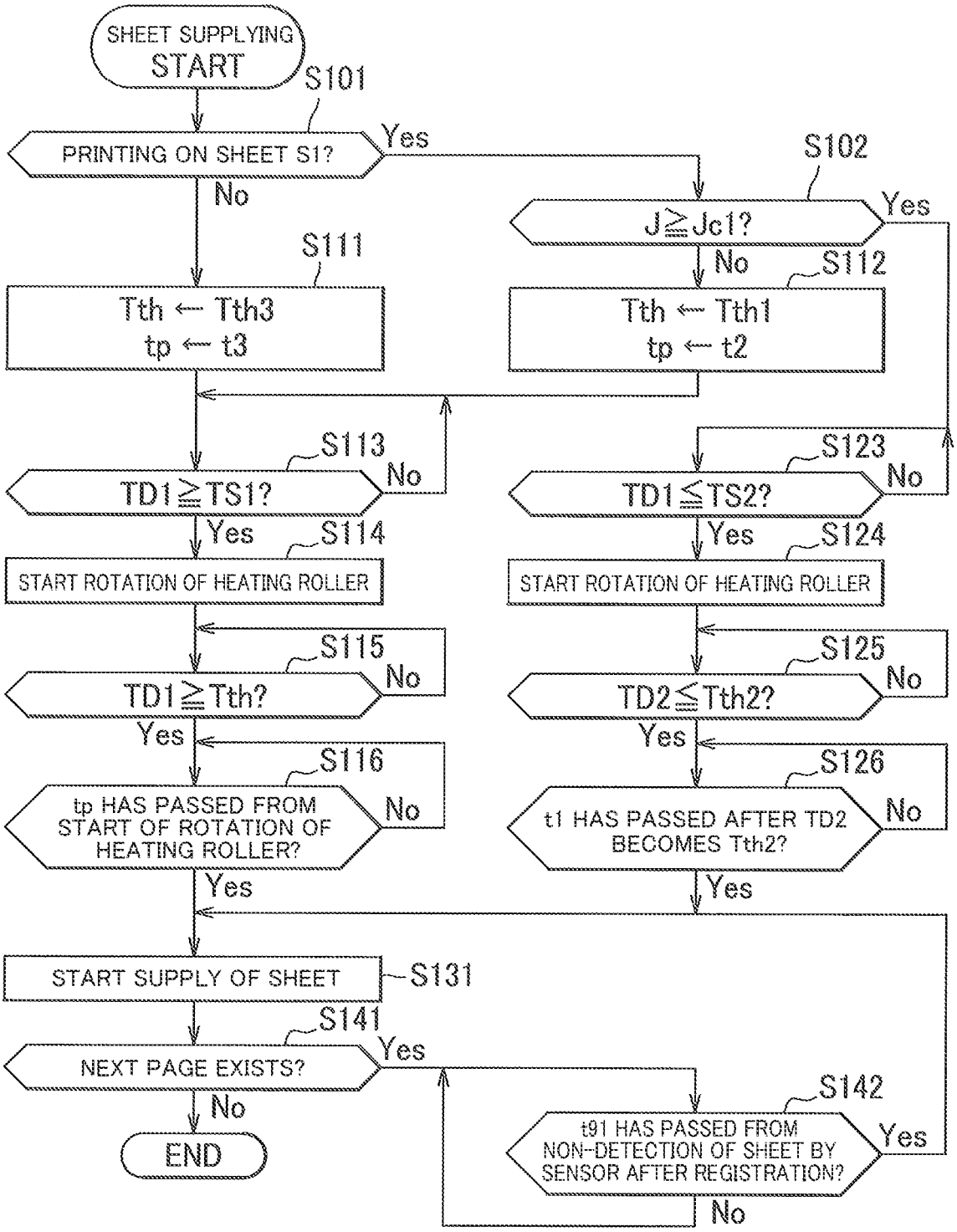
FIG. 8 is a flowchart illustrating a sheet supplying process according to the first embodiment.

When it is determined that the next page does not exist in the print job at Step S141 (No), the controller 100 ends the sheet supplying process illustrated in FIG. 8.

According to the first embodiment described above, the timing when the supply of the sheet S is started is changed in accordance with the heat storage amount of the fixing unit 8 stored by the heating of the second heater 84; therefore, it is possible to execute control in accordance with the heat storage amount of the fixing unit 8 stored by the heating of the second heater 84.

Specifically, when the heat storage amount of the fixing unit 8 is high, namely, when the heat storage amount of the fixing unit 8 is equal to or greater than the predetermined amount, the temperature of the entire fixing unit 8 is high by the heating of the heaters 83, 84; therefore, there is a possibility that the sheet S is heated more than necessary when the sheet S is supplied to the fixing unit 8. In particular, in the case of the sheet S1 such as coated paper having the coated layer on the surface, the coated layer may be deformed due to water vapor generated from the paper when the sheet is heated more than necessary when the sheet S1 is supplied to the fixing unit 8.

When the heat storage amount of the fixing unit 8 is equal to or greater than the predetermined amount in the case where the image forming on the sheet S1 such as coated paper is started, the supply of the sheet S1 can be started after reducing the second detected-temperature TD2 to be the second threshold temperature Tth2 in the embodiment as illustrated in FIG. 6. Accordingly, it is possible to suppress that the sheet S1 is heated more than necessary when being supplied to the fixing unit 8.

Even when the heat storage amount of the fixing unit 8 is low, namely, even when the heat storage amount of the fixing unit 8 is less than the predetermined amount, there may be a case where the temperature of the fixing unit 8 is partially increased in the vicinity of the peak positions P1, P2 of the output of the second heater 84 particularly by the heating of the second heater 84, and the sheet S may be heated more than necessary at portions where the temperature is partially increased when the sheet S is supplied to the fixing unit 8.

When the heat storage amount of the fixing unit 8 is less than the predetermined amount in the case where the image forming on the sheet S1 is started, the target temperatures TT1, TT2 to be set when the toner image is fixed on the sheet S1 are reduced to temperatures less than the target temperatures TT4, TT5 to be set when the toner image is fixed on the sheet S2 such as plain paper in the embodiment as illustrated in FIG. 5; therefore, it is possible to suppress that the sheet S1 is heated more than necessary when being supplied to the fixing unit 8.

Then, since it is possible to suppress that the sheet S1 is heated more than necessary when being supplied to the fixing unit 8 as described above, it is possible to suppress generation of water vapor from paper. Accordingly, it is possible to suppress that the coated layer is deformed due to generated water vapor.

The target temperature at the end area 812 of the heating roller 81 is set to the third target temperature TT3 that is less than the second target temperature TT2 before starting the supply of the sheet S1; therefore, it is possible to suppress the increase in temperature at the end area 812 of the heating roller 81 before starting the supply of the sheet S1. Accordingly, when the heat storage amount of the fixing unit 8 is equal to or greater than the predetermined amount, the second detected-temperature TD2 can be quickly reduced to be the second threshold temperature Tth2. When the heat storage amount of the fixing unit 8 is less than the predetermined amount, it is possible to suppress that the temperature at the end area 812 is rapidly increased and that the temperature at the end area 812 is increased too much.

The heat storage amount of the fixing unit 8 stored by the heating of the second heater 84 is determined based on the output of the second heater 84, specifically, based on the parameter Pa which is proportion to the energization duty ratio D2; therefore, it is possible to accurately determine whether the heat storage amount of the fixing unit 8 is equal to or greater than the predetermined amount or not.

The second detected-temperature TD2 is detected in the state in which the second temperature sensor 86 is in contact with the heating roller 81; therefore, the second detected-temperature TD2 can be accurately detected.

The first detected-temperature TD1 is detected in the state in which the first temperature sensor 85 is not in contact with the minimum contact area A2 of the heating roller 81; therefore, the first detected-temperature TD1 can be detected in the state in which the minimum contact area A2 and the first temperature sensor 85 are not in contact with each other. Accordingly, it is possible to suppress that a rub mark appears at the minimum contact area A2 and affects the image quality.

Next, a second embodiment will be explained. In the second embodiment, the sheet S is, for example, plain paper. In the following description, detailed explanation for the same points as those in the embodiment explained above is dispensed with while the same symbols are given to the same components, and points different from those in the embodiment explained above will be explained in detail.

Figure 9:
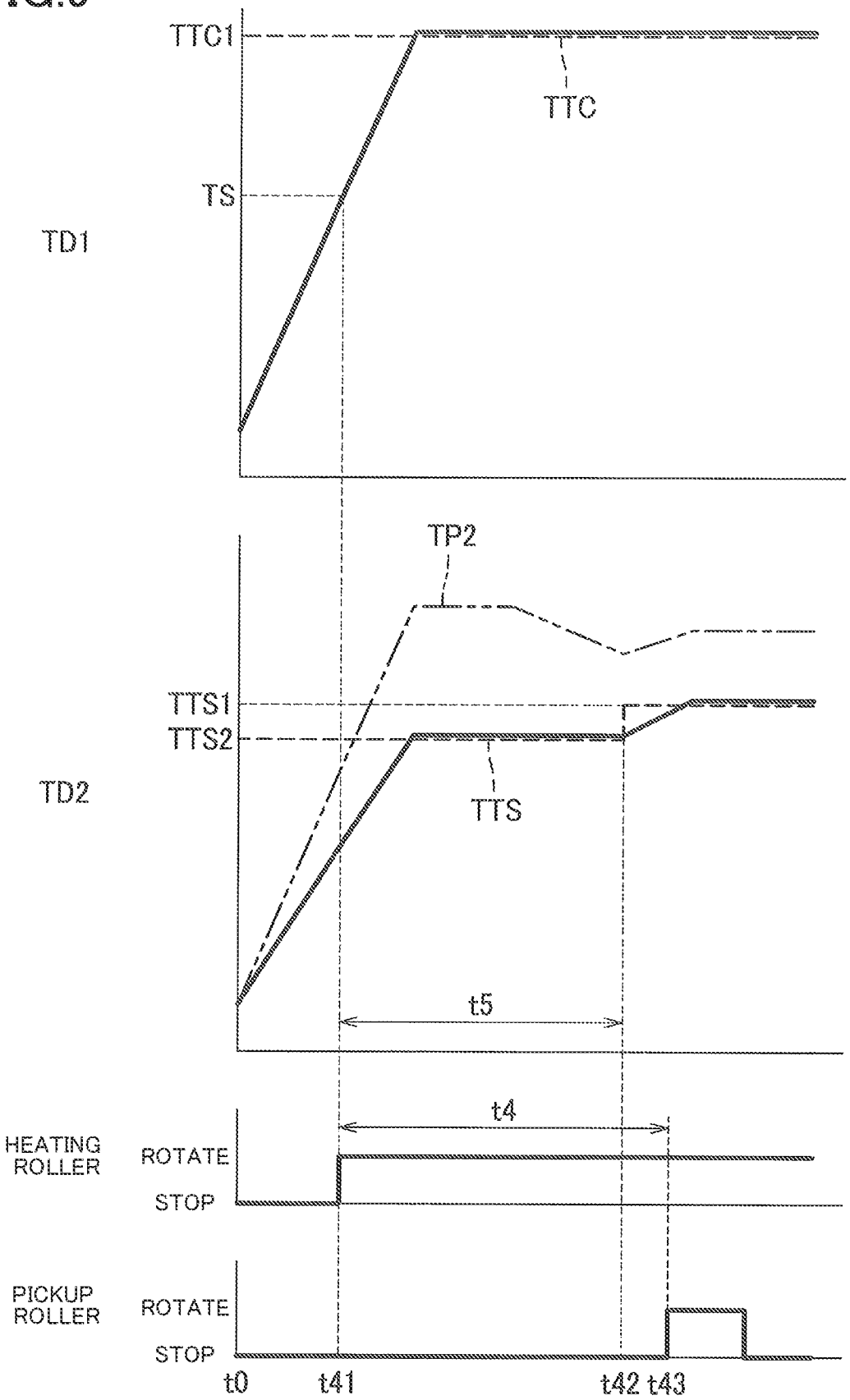
FIG. 9 is a timing chart for explaining control executed in the case where the heat storage amount of the fixing unit is less than the predetermined amount when starting image forming on a sheet according to a second embodiment.
Figure 10:
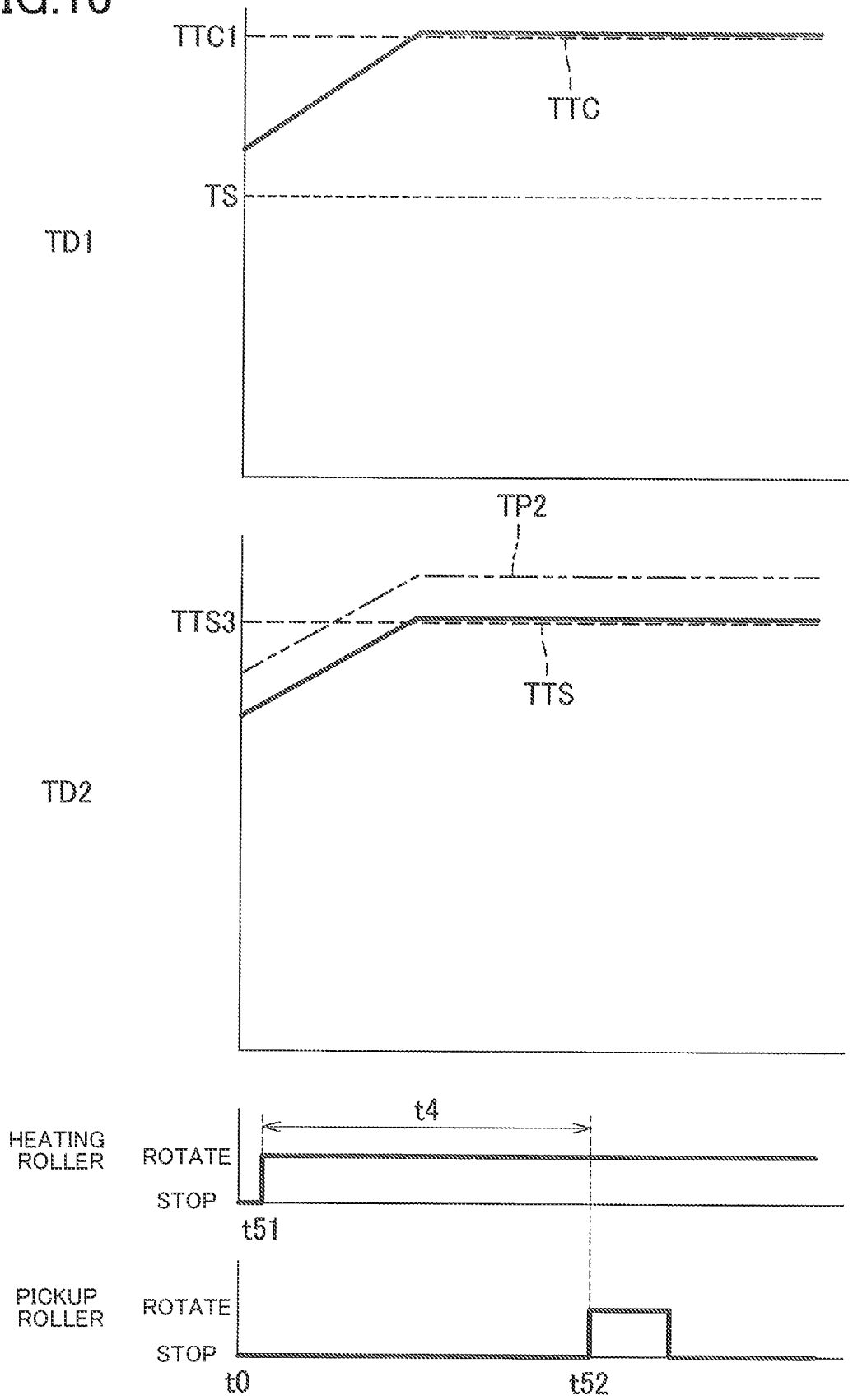
FIG. 10 is a timing chart for explaining control executed in the case where the heat storage amount of the fixing unit is equal to or greater than the predetermined amount when starting the image forming on the sheet according to the second embodiment.

As illustrated in FIG. 9 and FIG. 10, the controller 100 sets a target temperature TTC at the central area 811 of the heating roller 811 to a central target temperature TTC1 in the case where the image forming on the sheet S is started. The central target temperature TTC1 is a target temperature at the central area 811 to be set when the toner image is fixed on the sheet S.

When the first detected-temperature TD1 is equal to or greater than a rotation start temperature TS in the case where the image forming on the sheet S is started, the controller 100 starts rotation of the heating roller 81. The rotation start temperature TS is a temperature less than the central target temperature TTC1.

Moreover, the controller 100 rotates the pickup roller 33 to start the supply of the sheet S when a fourth period of time t4 has passed from the start of rotation of the heating roller 81.

The controller 100 changes a target temperature TTS at the end area 812 of the heating roller 81 in accordance with the heat storage amount of the fixing unit 8 stored by the heating of the second heater 84 in the case where the image forming on the sheet S is started. Specifically, when the heat storage amount of the fixing unit 8 is less than the predetermined amount, the controller 100 sets the target temperature TTS at the end area 812 to a temperature less than a temperature to be set when the heat storage amount of the fixing unit 8 is equal to or greater than the predetermined amount in the case where the image forming on the sheet S is started.

Specifically, as illustrated in FIG. 10, when the heat storage amount of the fixing unit 8 is equal to or greater than the predetermined amount in the case where the image forming on the sheet S is started, the controller 100 sets the target temperature TTS at the end area 812 to a third end target temperature TTS3. Specifically, the controller 100 determines that the heat storage amount of the fixing unit 8 is equal to or greater than the predetermined amount when the accumulated value J of the parameter Pa is equal to or greater than a predetermined threshold value Jc0, and sets the target temperature TTS at the end area 812 to the third end target temperature TTS3.

The third end target temperature TTS3 is the target temperature at the end area 812 to be set when the toner image is fixed on the sheet S in the case where the heat storage amount of the fixing unit 8 is equal to or greater than the predetermined amount. The third end target temperature TTS3 is the same temperature as the central target temperature TTC1 in the embodiment. It is noted that the third end target temperature TTS3 may be a different temperature from the central target temperature TTC1. The threshold value Jc0 may be the same value as the threshold value Jc1 according to the first embodiment, and may be different from the threshold value Jc1.

When the heat storage amount of the fixing unit 8 is less than the predetermined amount in the case where the image forming on the sheet S is started, the controller 100 sets the target temperature TTS at the end area 812 to a second end target temperature TTS2 as illustrated in FIG. 9. Specifically, the controller 100 determines that the heat storage amount of the fixing unit 8 is less than the predetermined amount when the accumulated value J of the parameter Pa is less than the threshold value Jc0 and sets the target temperature TTS at the end area 812 to the second end target temperature TTS2.

After that, the controller 100 sets the target temperature TTS at the end area 812 to a first end target temperature TTS1 when a predetermined condition is satisfied. Specifically, the controller 100 determines that the predetermined condition is satisfied when a fifth period of time t5 has passed from the start of the rotation of the heating roller 81, and the controller 100 changes the target temperature TTS at the end area 812 to the first end target temperature TTS1.

The first end target temperature TTS1 is the target temperature at the end area 812 to be set when the toner image is fixed on the sheet S when the heat storage amount of the fixing unit 8 is less than the predetermined amount. Each of the first end target temperature TTS1 and the second end target temperature TTS2 is less than the third end target temperature TTS3 (see FIG. 10) as well as less than the central target temperature TTC1. The second end target temperature TTS2 is less than the first end target temperature TTS1. The fifth period of time t5 is a period of time shorter than the fourth period of time t4.

Next, an example of operations of the controller 100 according to the second embodiment will be explained more specifically with reference to flowcharts and timing charts.

The controller 100 repeatedly executes the accumulation calculation process illustrated in FIG. 7 by each unit time tc (the predetermined control cycle) after the power of the image forming apparatus 1 is supplied.

Figure 11:
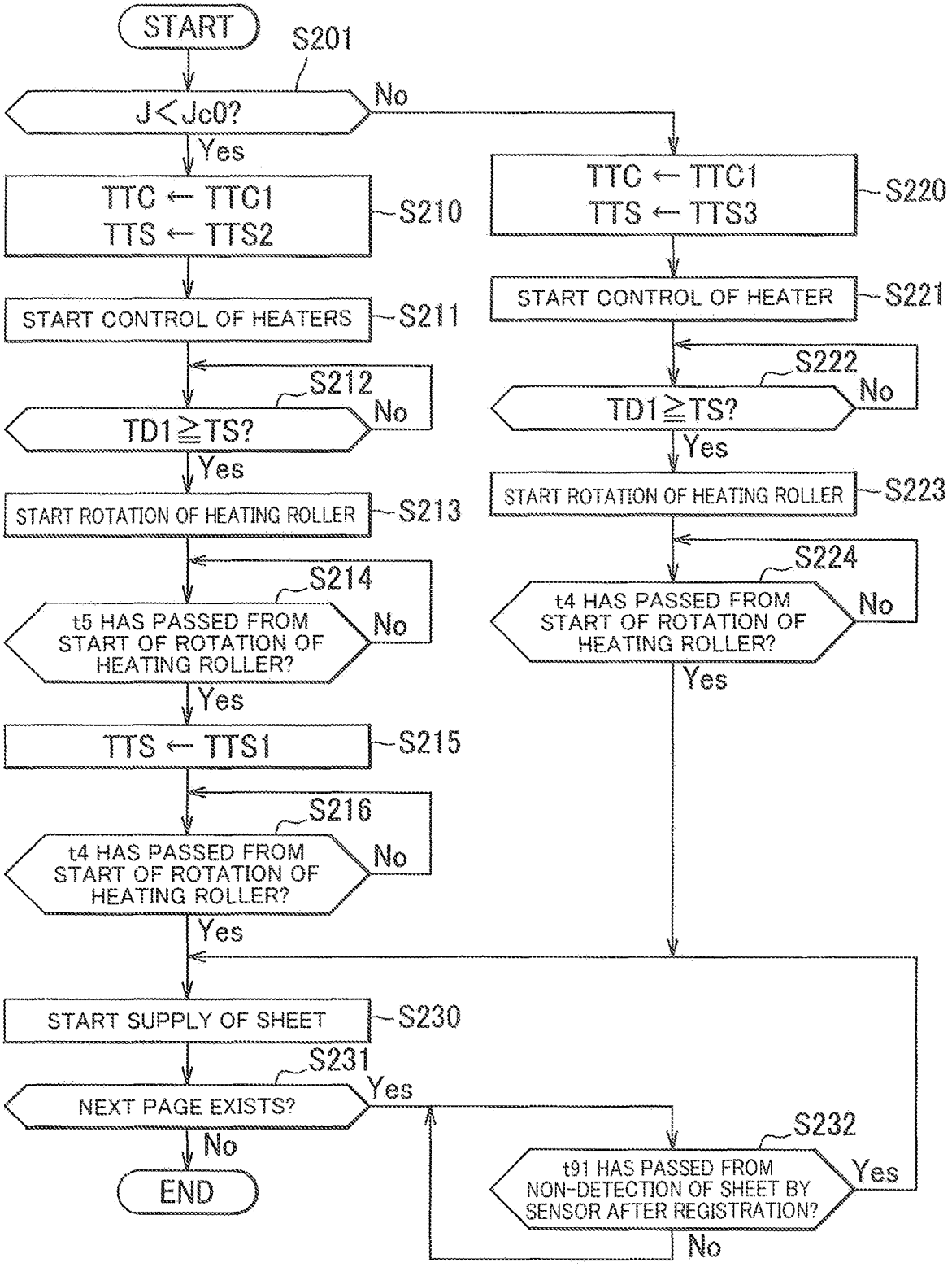
FIG. 11 is a flowchart illustrating operations of a controller according to the second embodiment.

As illustrated in FIG. 11, the controller 100 determines whether the accumulated value J of the parameter Pa is less than the threshold value Jc0 or not (S201) when receiving the print job (FIG. 9 and FIG. 10, "t0").

Since the heat storage amount of the fixing unit 8 is less than the predetermined amount when the accumulated value J of the parameter Pa is less than the threshold value Jc0 (S201, Yes), the controller 100 sets the target temperature TTS at the central area 811 to the central target temperature TTC1 and sets the target temperature TTC at the end area 812 to the second end target temperature TTS2 (S210) (see FIG. 9). Then, the controller 100 starts control of the first heater 83 and the second heater 84 (S211).

Next, the controller 100 determines whether the first detected-temperature TD1 is equal to or greater than the rotation start temperature TS or not (S212). When it is determined that the first detected-temperature TD1 is not equal to or greater than the rotation start temperature TS (S212, No), the controller 100 waits until the first detected-temperature TD1 becomes equal to or greater than the rotation start temperature TS. When it is determined that the first detected-temperature TD1 becomes equal to or greater than the rotation start temperature TS (S212, Yes), the controller 100 starts the rotation of the heating roller 81 (S213) (FIG. 9, t41).

After that, the controller 100 determines whether the fifth period of time t5 has passed from the start of the rotation of the heating roller 81 (S214). When the fifth period of time t5 has passed (Yes), the controller 100 changes the target temperature TTS at the end area 812 to the first end target temperature TTS1 (S215) (FIG. 9, t42).

After that, the controller 100 determines whether the fourth period of time t4 has passed from the start of rotation of the heating roller 81 (S216). When it is determined that the fourth time t4 has passed (Yes), the controller 100 rotates the pickup roller 33 to start the supply of the first sheet S (S230) (FIG. 9, t43). Then, the controller 100 forms an image on the supplied sheet S.

Since the heat storage amount of the fixing unit 8 is equal to or greater than the predetermined amount when the accumulated value J of the parameter Pa is equal to or greater than the threshold value Jc0 at Step S201 (No), the controller 100 sets the target temperature TTC at the central area 811 to the central target temperature TTC1 and sets the target temperature TTS at the end area 812 to the third end target temperature TTS3 (S220) (see FIG. 10). Then, the controller 100 starts control of the first heater 83 and the second heater 84 (S221).

Next, the controller 100 determines whether the first detected-temperature TD1 is equal to or greater than the rotation start temperature TS or not (S222). When it is determined that the first detected-temperature TD1 is equal to or greater than the rotation start temperature TS (Yes), the controller 100 starts the rotation of the heating roller 81 (S223) (FIG. 10, t51).

After that, the controller 100 determines whether the fourth period of time t4 has passed from the start of rotation of the heating roller 81 (S224). When it is determined that the fourth period of time t4 has passed (Yes), the controller 100 rotates the pickup roller 33 to start the supply of the first sheet S (S230) (FIG. 10, t52). Then, the controller 100 forms an image on the supplied sheet S.

After the supply of the first sheet is started, the controller 100 determines whether a next page exists in the print job (S231). When the next page exists (S231, Yes), the controller 100 determines whether the predetermined period of time t91 has passed from a timing when the sensor after registration 22 does not detect a preceding sheet S or not (S232). When the predetermined period of time t91 has not passed (S232, No), the controller 100 waits until the time passes. When it is determined that the predetermined period of time t91 pass passed (S232, Yes), the controller 100 returns to the process of Step S230, rotates the pickup roller 33 and starts the supply of a next sheet S (the second and subsequent sheets S) to thereby form an image on the supplied sheet S.

When it is determined that the next page does not exist in the print job at Step S231 (No), the controller 100 ends the process.

According to the second embodiment described above, the target temperature TTS at the end area 812 of the heating roller 81 is changed in accordance with the heat storage amount of the fixing unit 8 stored by the heating of the second heater 84; therefore, it is possible to execute control in accordance with the heat storage amount of the fixing unit 8 stored by the heating of the second heater 84.

Specifically, when the image forming on the sheet S is started in the state in which the heat storage amount of the fixing unit 8 by the heating of the second heater 84 is low, that is, in the state in which the heat storage amount of the fixing unit 8 is less than the predetermined amount, since outputs of the heaters 83, 84 are increased, the temperature of the fixing unit 8 (the heating roller 81) is partially increased in the vicinity of the peak positions P1, P2 of the output of the second heater 84. At this time, deviation between the second detected-temperature TD2 detected by the second temperature sensor 86 and a temperature in the vicinity of the peak positions P1, P2 of the output of the second heater 84 becomes large, and there is a possibility that the sheet S is heated more than necessary in the vicinity of the peak positions P1, P2 of the output of the second heater 84 when the sheet S is supplied to the fixing unit 8.

In the embodiment, as illustrated in FIG. 9, when the heat storage amount of the fixing unit 8 stored by the heating of the second heater 84 is less than the predetermined amount when the image forming on the sheet is started, the target temperature TTS at the end area 812 is reduced to a temperature less than in the case where the heat storage amount is equal to or greater than the predetermined amount; therefore, it is possible to suppress that the temperature in the vicinity of the peak positions P1, P2 of the output of the second heater 84 in the end areas 812 is increased. Specifically, it is possible to suppress the increase of deviation between the second detected-temperature TD2 and a temperature TP2 in the vicinity of the peak positions P1, P2 of the output of the second heater 84. Accordingly, it is possible to suppress that the sheet S is heated more than necessary when the sheet S is supplied to the fixing unit 8.

When the heat storage amount of the fixing unit 8 by the second heater 84 is less than the predetermined amount in the case where the image forming on the sheet S is started, the target temperature TTS at the end area 812 is set to the second end target temperature TTS2 that is less than the first end target temperature TTS1 to be set when the toner image is fixed on the sheet S; therefore, it is possible to further suppress the increase of the temperature in the vicinity of the peak positions P1, P2 of the output of the second heater 84 in the width direction in the end area 812. Accordingly, it is possible to further suppress that the sheet S is heated more than necessary when the sheet S is supplied to the fixing unit 8.

It is noted that, as illustrated in FIG. 10, when the image forming on the sheet S is started in the case where the heat storage amount of the fixing unit 8 stored by the heating of the second heater 84 is high, namely, in the case where the heat storage amount of the fixing unit 8 is equal to or greater than the predetermined amount, the fixing unit 8 is heated to some degree; therefore, the outputs of the heaters 83, 84 are not increased so much. Accordingly, the deviation between the second detected-temperature TD2 and the temperature TP2 in the vicinity of the peak positions P1, P2 of the output of the second heater 84 is small.

The embodiments have been explained above, and the present disclosure is not limited to the above embodiments and can be achieved by being suitably modified as illustrated as follows.

For example, in the case where the image forming on the sheet S1 such as coated paper is started, the target temperature at the end area 812 of the heating roller 81 is set to the third target temperature TT3 before starting the supply of the sheet S, and the target temperature at the end area 812 is changed to the second target temperature TT2 when the supply of the sheet S1 is started in the first embodiment as illustrated in FIG. 6 and the like; however, the timing is not limited to this.

For example, the timing when the target temperature is changed is not limited to the timing when the supply of the sheet S1 is started, but the timing when the target temperature is changed may be a timing before starting the supply of the sheet S1 as well as a timing after starting the supply of the sheet S1 as long as it is a timing so that the temperature at a nip portion between the heating roller 81 and the pressure unit 82 at a timing just before the sheet S1 reaches the nip portion becomes the second target temperature TT2.

In the case where the image forming on the sheet S1 is started, the target temperature at the end area 812 may be set to the second target temperature TT2 in a stage in which the print job is received (t0).

The second threshold temperature Tth2 is the temperature less than the second target temperature TT2 in the first embodiment; however, it is not limited to this. For example, the second threshold temperature may be the same temperature as the second target temperature.

The supply of the sheet S1 is started when the first period of time t1 has passed after the second detected-temperature TD2 becomes the second threshold temperature Tth2 in the case where the heat storage amount of the fixing unit 8 is equal to or greater than the predetermined amount in the first embodiment; however, it is not limited to this. For example, the supply of the sheet S1 may be started when the second detected-temperature becomes equal to or less than the second threshold temperature without waiting until the first time passes.

The supply of the sheet S1 is stared when the second period of time t2 has passed in the case where the condition that the first detected-temperature TD1 becomes equal to or greater than the first threshold temperature Tth1 is satisfied when the heat storage amount of the fixing unit 8 is less than the predetermined amount in the first embodiment; however, it is not limited to this. For example, the supply of the sheet may be started when the first detected-temperature becomes equal to or greater than the first threshold temperature without waiting until the second time passes.

The supply of the sheet S2 is started when the third period of time t3 has passed in the case where the condition that the first detected-temperature TD1 becomes equal to or greater than the third threshold temperature Tth3 is satisfied when the image forming on the sheet S2 such as plain paper is started in the first embodiment; however, it is not limited to this. For example, the supply of the sheet may be started when the first detected-temperature TD1 becomes equal to or greater than the third threshold temperature without waiting until the third time passes.

When the heat storage amount of the fixing unit 8 is less than the predetermined amount in the case where the image formation on the sheet S is started, the target temperature TTS at the end area 812 is set to the second end target temperature TTS2, then, the target temperature TTS is set to the first end target temperature TTS1 when the predetermined condition is satisfied in the second embodiment. Then, the timing when the predetermined condition is satisfied is set to the timing when the fifth period of time t5 shorter than the fourth period of time t4 has passed from the start of the rotation of the heating roller 81, in other words, the timing when the target temperature TTS is changed is set to the timing before the supply of the sheet S is started; however, it is not limited to this.

For example, the timing when the target temperature TTS is changed may be the same as the timing when the supply of the sheet S is started. Specifically, for example, the target temperature TTS at the end area 812 may be changed from the second end target temperature TTS2 to the first end target temperature TTS1 when the fourth period of time t4 has passed from the start of the rotation of the heating roller 81.

The timing when the target temperature TTS is changed may be the timing after the supply of the sheet S is started. Specifically, for example, the target temperature TTS may be changed to a timing when a sixth period of time longer than the fourth period of time t4 has passed from the start of the rotation of the heating roller 81. Moreover, the target temperature TTS may be changed to a timing when a seventh period of time has passed after the start of the rotation of the pickup roller 33 for starting the supply of the sheet S. Furthermore, the target temperature TTS may be changed to a timing when a sensor disposed downstream of the pickup roller 33 for detecting the sheet S detects the sheet S or when a predetermined period of time has passed from the detection of the sheet S.

When the heat storage amount of the fixing unit 8 is less than the predetermined amount in the case where the image formation on the sheet S is started, the target temperature TTS at the end area 812 is first set to the second end target temperature TTS2, then, target temperature TTS is set to the first end target temperature TTS1 in the second embodiment; however, it is not limited to this. For example, the target temperature TTS at the end area 812 may be set to the first end target temperature TTS1 to be set when the toner image is fixed on the sheet S from the beginning.

The supply of the sheet S is started when the fourth period of time t4 has passed from the start of the rotation of the heating roller 81 in the second embodiment; however, it is not limited to this. For example, the supply of the sheet may be started in a case where a condition that the detected-temperature detected by the temperature sensor reaches a predetermined temperature is satisfied in addition to satisfaction of the condition that the predetermined period of time has passed from the start of the rotation of the heating roller.

In the above embodiment, whether the heat storage amount of the fixing unit 8 is equal to or greater than the predetermined amount or not is determined by determining whether the accumulated value J of the parameter Pa which is proportion to the output of the second heater 84 is equal to or greater than the threshold values Jc1, Jc0 or not; however, it is not limited to this. For example, whether the heat storage amount is equal to or greater than the predetermined amount or not may be determined by determining whether an accumulated value of the number of prints within a predetermined period of time just before starting the image forming on the sheet is equal to or greater than a predetermined threshold value or not. Specifically, when the accumulated value of the number of prints within the predetermined time is less than the threshold value, the heat storage amount of the fixing unit may be determined to be less than the predetermined amount. When the accumulated value of the number of prints within the predetermined time is equal to or greater than the threshold value, the heat storage amount of the fixing unit may be determined to be equal to or greater than the predetermined amount.

In the above embodiment, the second detected-temperature TD2 is detected in the state in which the second temperature sensor 86 is in contact with the heating roller 81; however, it is not limited to this. The second detected-temperature may be detected in a state in which the second temperature sensor is not in contact with the heating roller. Also in the above embodiment, the first detected-temperature TD1 is detected in the state in which the first temperature sensor 85 is not in contact with the heating roller 81; however, it is not limited to this. The first detected-temperature may be detected in a state in which the first temperature sensor is in contact with the heating roller. The thermistor is illustrated as an example for the temperature sensors 85, 86 in the above embodiment; however, any type of sensor may be adopted as long as a sensor can detect the temperature of the heating roller.

The specific configuration of the fixing unit is not limited to the configuration according to the embodiment. For example, the configuration in which the heating roller 81 has the elastic layer 81B on the outer circumference is adopted in the embodiment; however, the configuration is not limited to this. A configuration in which the heating roller does not have the elastic layer on the outer circumference may be adopted. In the above embodiment, the hardness differs between the first elastic member 182 and the second elastic member 183; however, it is not limited to this. The first elastic member and the second elastic member may have the same hardness. Also in the above embodiment, the fixing unit 8 includes the pressure unit 82 having the endless belt 181 and the elastic members 182, 183; however, the fixing unit is not limited to this. For example, the fixing unit may have a pressure roller having a core metal and an elastic layer formed on an outer circumference of the core metal, instead of the pressure unit 82 according to the embodiment.

In the above embodiment, the halogen heater using radiant heat is illustrated as an example for the heaters 83, 84; however, the heater is not limited to this. For example, the heater may be a ceramic heater or a carbon heater using heat generation of a resistance element, an IH heater induction-heating a heating portion, or the like. The heater can be disposed outside the heating portion, not inside the heating portion.

The specific configuration of the sheet supplier is not limited to the configuration of the embodiment. For example, the sheet supplier may have a configuration in which a plurality of supply trays are provided and the sheet is selectively supplied from the plurality of supply trays to the image forming unit. The sheet supplier may also have a configuration in which the sheet is supplied from a so-called manual feed tray to the image forming unit, not from the supply tray mountable/detachable to the housing of the image forming apparatus. The sheet supplier may also have a configuration in which the supply tray and the manual feed tray are both provided and the sheet is supplied to the image forming unit selectively from the supply tray and the manual feed tray.

The specific configuration of the image forming unit is not limited to the above configuration of the embodiment. For example, the exposing unit of the image forming unit may have a configuration including an exposing head in which a plurality of LEDs are disposed, in which the surfaces of the photoconductive drums are exposed with light from the LEDs. The image forming unit may include a photoconductive belt instead of the photoconductive drums 61. The image forming unit may include an intermediate transfer belt instead of the conveying belt 73.

The color printer is illustrated as an example of the image forming apparatus in the above embodiment; however, the present disclosure is not limited to this. For example, the image forming apparatus may be a monochrome printer capable of forming only monochrome images. Moreover, the image forming apparatus is not limited to the printer but may also be, for example, a copy machine, a multifunction peripheral, and the like.

Respective components explained in the above embodiments and modification examples may be arbitrarily combined to achieve the disclosure. For example, when the heat storage amount of the fixing unit is less than the predetermined amount in the case where the image forming on the first kind of sheet is started, the target temperature at the end area may be set to a temperature less than the temperature to be set in the case where the heat storage amount is equal to or greater than the predetermined amount. When the heat storage amount of the fixing unit is equal to or greater than the predetermined amount, the supply of the sheet may be started at the timing later than the timing to be taken when the heat storage amount is less than the predetermined amount on condition that the second detected-temperature is reduced to be equal to or less than the second threshold temperature. Accordingly, it is possible to suppress that the first kind of sheet is heated more than necessary when being supplied to the fixing unit.

What is claimed is:

1. An image forming apparatus configured to form an image on a sheet, comprising:

a photoconductive drum;

a developing roller;

a sheet supplier configured to supply a sheet to the photoconductive drum;

a fixing unit configured to fix a toner image on a sheet; and a controller, wherein the fixing unit includes a heating roller configured to heat the sheet, a first heater configured to heat a central area containing a central part of the heating roller in a width direction orthogonal to a conveying direction of the sheet, the first heater being configured to heat the central area more strongly than end areas respectively positioned on outer sides of the central area in the width direction of the heating roller, a second heater configured to heat the end areas more strongly than the central area, a first temperature sensor for detecting a temperature at the central area, and a second temperature sensor for detecting a temperature at the end area, and wherein the controller is configured to control the first heater so that a first detected-temperature detected by the first temperature sensor becomes a target temperature at the central area, and control the second heater so that a second detected-temperature detected by the second temperature sensor becomes a target temperature at the end area, determine a heat storage amount of the fixing unit stored by the heating of the second heater calculated by accumulating a parameter which is proportional to an output of the second heater by each unit time, and in accordance with the heat storage amount, change (i) a timing when supply of the sheet is started, or (ii) the target temperature at the end area.

2. The image forming apparatus according to claim 1, wherein, in a case where forming an image on a first kind of sheet is started, the controller is configured to:

when the heat storage amount is less than a predetermined amount, start supplying the first kind of sheet on condition that the first detected-temperature becomes equal to or greater than a first threshold temperature that is less than a first target temperature which is a target temperature at the central area which is to be set when the toner image is fixed on the first kind of sheet, and when the heat storage amount is equal to or greater than the predetermined amount, start the supply of the first kind of sheet on condition that the second detected-temperature becomes equal to or less than a second threshold temperature that is equal to or less than a second target temperature which is a target temperature at the end area which is to be set when the toner image is fixed on the first kind of sheet.

3. The image forming apparatus according to claim 2, wherein the controller is configured to set, before starting supply of the first kind of sheet, the target temperature at the end area to a third target temperature that is less than the second target temperature.

4. The image forming apparatus according to claim 2, wherein, in a case where the heat storage amount is equal to or greater than the predetermined amount and a condition that the second detected-temperature becomes, after starting rotation of the heating roller, equal to or less than the second threshold temperature is satisfied, the controller is configured to start supply of the first kind of sheet at a timing when a first period of time has passed from a timing when the second detected-temperature becomes the second threshold temperature.

5. The image forming apparatus according to claim 2, wherein, in a case where the heat storage amount is less than the predetermined amount and a condition that the first detected-temperature becomes equal to or greater than the first threshold temperature in a period from a timing when the heating roller is stared to be rotated to a timing when a second period of time has passed from the start of rotation of the heating roller is satisfied, the controller is configured to start supply of the first kind of sheet at a timing when the second period of time has passed from the timing of start of rotation of the heating roller.

6. The image forming apparatus according to claim 2, wherein, when image forming on a second kind of sheet different from the first kind of sheet is started, the controller is configured to start supply of the second kind of sheet on condition that the first detected-temperature becomes equal to or greater than a third threshold temperature that is less than a fourth target temperature which is a target temperature at the central area to be set when the toner image is fixed on the second kind of sheet.

7. The image forming apparatus according to claim 6, wherein, in a case where the image forming on the second kind of sheet is started and on condition that the first detected-temperature becomes equal to or greater than the third threshold temperature in a period from a timing when the heating roller is started to be rotated to a timing when a third period of time has passed from the start of rotation of the heating roller is satisfied, the controller is configured to start supply of the second kind of sheet when the third period of time has passed from the timing of start of rotation of the heating roller.

8. The image forming apparatus according to claim 6, wherein the first target temperature is less than the fourth target temperature, and wherein the second target temperature is less than the target temperature at the end area to be set when the toner image is fixed on the second kind of sheet.

9. The image forming apparatus according to claim 1, wherein the second temperature sensor is located at a position different from peak positions of an output of the second heater in the width direction, and wherein the controller is configured to, when the heat storage amount is less than the predetermined amount at the time of starting the image forming on the sheet, set the target temperature at the end area to a temperature less than a temperature to be set when the heat storage amount is equal to or greater than the predetermined amount.

10. The image forming apparatus according to claim 9, wherein, when the heat storage amount is less than the predetermined amount in the state in which the image forming on the sheet is started, the controller is configured to set the target temperature at the end area to a second end target temperature that is less than a first end target temperature which is a temperature to be set when the toner image is fixed on the sheet, then, when a predetermined condition is satisfied, set the target temperature at the end area to the first end target temperature.

11. The image forming apparatus according to claim 10, wherein the controller is configured to start the supply of the sheet when a fourth period of time has passed from a timing when the heating roller is started to be rotated.

12. The image forming apparatus according to claim 11, wherein the controller is configured to determine that the predetermined condition is satisfied when a fifth period of time which is less than the fourth period of time has passed from the start of rotation of the heating roller.

13. The image forming apparatus according to claim 9, wherein the heating roller has a maximum contact area with which a sheet with a maximum size in the width direction conveyed in the image forming apparatus comes into contact, and wherein peak positions of the output in the width direction of the second heater are located within the maximum contact area in the width direction.

14. The image forming apparatus according to claim 13, wherein the heating roller has a minimum contact area with which a sheet with a minimum size in the width direction conveyed in the image forming apparatus comes into contact, and wherein peak positions of the output in the width direction of the second heater are located on outer sides of the minimum contact area in the width direction.

15. The image forming apparatus according to claim 2, wherein the controller is configured to:

determine that the heat storage amount is less than the predetermined amount when an accumulated value of the parameter is less than a predetermined threshold value, and determine that the heat storage amount is equal to or greater than the predetermined amount when the accumulated value of the parameter is equal to or greater than the predetermined threshold value.

16. The image forming apparatus according to claim 15, wherein the controller is configured to start to accumulate the parameter when the second detected-temperature becomes equal to or greater than a predetermined temperature.

17. The image forming apparatus according to claim 16, wherein the controller is configured to reset the accumulated value of the parameter when the second detected-temperature becomes less than the predetermined temperature.

18. The image forming apparatus according to claim 1, wherein the heating roller has non-contact areas with which a sheet with the maximum size in the width direction conveyed in the image forming apparatus does not come into contact, and wherein the second temperature sensor is configured to detect the temperature at the non-contact area.

19. The image forming apparatus according to claim 1, wherein the heating roller has a minimum contact area with which a sheet with a minimum size in the width direction conveyed in the image forming apparatus comes into contact, and wherein the first temperature sensor is configured to detect the temperature at the minimum contact area.

20. An image forming apparatus configured to form an image on a sheet, comprising:

a photoconductive drum;

a developing roller;

a sheet supplier configured to supply a sheet to the photoconductive drum;

a fixing unit configured to fix a toner image on a sheet, the fixing unit comprising a heating roller, a heater configured to heat the heating roller, and a temperature sensor for detecting a temperature of the heating roller, and a controller configured to control the heater so that a detected-temperature detected by the temperature sensor becomes a target temperature, determine a heat storage amount of the fixing unit stored by the heating of the heater calculated by accumulating a parameter which is proportional to an output of the heater by each unit time, and in accordance with the heat storage amount, change (i) a timing of starting supply of the sheet, or (ii) the target temperature of the heating roller.

21. An image forming apparatus configured to form an image on a sheet, comprising:

a photoconductive drum;

a developing roller;

a sheet supplier configured to supply a sheet to the photoconductive drum;

a fixing unit configured to fix a toner image on a sheet; and a controller, wherein the fixing unit includes a heating roller configured to heat the sheet, a first heater configured to heat a central area containing a central part of the heating roller in a width direction orthogonal to a conveying direction of the sheet, the first heater being configured to heat the central area more strongly than end areas respectively positioned on outer sides of the central area in the width direction of the heating roller, a second heater configured to heat the end areas more strongly than the central area, a first temperature sensor for detecting a temperature at the central area, and a second temperature sensor for detecting a temperature at the end area, wherein the controller is configured to control the first heater so that a first detected-temperature detected by the first temperature sensor becomes a target temperature at the central area, and control the second heater so that a second detected-temperature detected by the second temperature sensor becomes a target temperature at the end area, and in accordance with a heat storage amount of the fixing unit stored by the heating of the second heater, change (i) a timing when supply of the sheet is started, or (ii) the target temperature at the end area, and wherein, in a case where forming an image on a first kind of sheet is started, the controller is configured to when the heat storage amount is less than a predetermined amount, start supplying the first kind of sheet on condition that the first detected-temperature becomes equal to or greater than a first threshold temperature that is less than a first target temperature which is a target temperature at the central area which is to be set when the toner image is fixed on the first kind of sheet, and when the heat storage amount is equal to or greater than the predetermined amount, start the supply of the first kind of sheet on condition that the second detected-temperature becomes equal to or less than a second threshold temperature that is equal to or less than a second target temperature which is a target temperature at the end area which is to be set when the toner image is fixed on the first kind of sheet.

22. The image forming apparatus according to claim 21, wherein the controller is configured to:

accumulate a parameter which is proportional to an output of the second heater by each unit time;

determine that the heat storage amount is less than the predetermined amount when an accumulated value of the parameter is less than a predetermined threshold value; and determine that the heat storage amount is equal to or greater than the predetermined amount when the accumulated value of the parameter is equal to or greater than the predetermined threshold value.

23. An image forming apparatus configured to form an image on a sheet, comprising:

a photoconductive drum;

a developing roller;

a sheet supplier configured to supply a sheet to the photoconductive drum;

a fixing unit configured to fix a toner image on a sheet, the fixing unit comprising a heating roller, a heater configured to heat the heating roller, a temperature sensor for detecting a temperature of the heating roller; and a controller configured to control the heater so that a detected-temperature detected by the temperature sensor becomes a target temperature, accumulate a parameter which is proportional to an output of the heater by each unit time, and in accordance with accumulated value of the parameter, change (i) a timing of starting supply of the sheet, or (ii) the target temperature of the heating roller, and wherein, in a case where forming an image on a first kind of sheet is started, the controller is configured to when the heat storage amount is less than a predetermined amount, start supplying the first kind of sheet on condition that the first detected-temperature becomes equal to or greater than a first threshold temperature that is less than a first target temperature which is a target temperature at the central area which is to be set when the toner image is fixed on the first kind of sheet, and when the heat storage amount is equal to or greater than the predetermined amount, start the supply of the first kind of sheet on condition that the second detected-temperature becomes equal to or less than a second threshold temperature that is equal to or less than a second target temperature which is a target temperature at the end area which is to be set when the toner image is fixed on the first kind of sheet.

24. The image forming apparatus according to claim 23, wherein the controller is configured to:

accumulate a parameter which is proportional to an output of the second heater by each unit time;

determine that the heat storage amount is less than the predetermined amount when an accumulated value of the parameter is less than a predetermined threshold value; and determine that the heat storage amount is equal to or greater than the predetermined amount when the accumulated value of the parameter is equal to or greater than the predetermined threshold value.

* * * * *